US008029315B2

(12) United States Patent
Purdy et al.

(10) Patent No.: US 8,029,315 B2
(45) Date of Patent: Oct. 4, 2011

(54) COAXIAL CABLE CONNECTOR WITH IMPROVED PHYSICAL AND RF SEALING

(75) Inventors: Eric Purdy, Constantia, NY (US); Raymond Palinkas, Canastota, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 94 days.

(21) Appl. No.: 12/472,169

(22) Filed: May 26, 2009

(65) Prior Publication Data

US 2010/0255721 A1 Oct. 7, 2010

Related U.S. Application Data

(60) Provisional application No. 61/165,508, filed on Apr. 1, 2009.

(51) Int. Cl.
*H01R 9/05* (2006.01)

(52) U.S. Cl. ..... 439/578; 439/585

(58) Field of Classification Search ..... 439/320, 439/322, 578, 583, 584, 585
See application file for complete search history.

(56) References Cited

U.S. PATENT DOCUMENTS

| | | | |
|---|---|---|---|
| 1,667,485 | A | 4/1928 | MacDonald |
| 1,766,869 | A | 6/1930 | Austin |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,805,399 | A | 9/1957 | Leeper |
| 2,870,420 | A | 1/1959 | Malek |
| 3,001,169 | A | 9/1961 | Blonder |
| 3,091,748 | A | 5/1963 | Takes et al. |
| 3,094,364 | A | 6/1963 | Lingg |

(Continued)

FOREIGN PATENT DOCUMENTS

CA 2096710 A1 11/1994

(Continued)

OTHER PUBLICATIONS

Lawrence, R. Electrical/Electronic Interconnection Systems: A Guide to Connector Design and Techniques. The Deutsch Company. 1975. 5 pages.

(Continued)

*Primary Examiner* — Thanh Tam Le
(74) *Attorney, Agent, or Firm* — Schmeiser, Olsen & Watts, LLP

(57) ABSTRACT

A coaxial cable connector for connecting a coaxial cable to an interface port and extending an RF shield therebetween is provided. The connector includes a connector body having a first end and a second end, a post, attached to the connector body, a threaded nut, rotatable with respect to the post and also axially movable with respect to the connector body between a first position and a second position, a biasing member, operable to move the nut, and a joint stop element, located to interact with the biasing member and introduce obstructive structure that impedes axial movement of the nut.

55 Claims, 15 Drawing Sheets

U.S. PATENT DOCUMENTS

| | | | |
|---|---|---|---|
| 3,184,706 | A | 5/1965 | Atkins |
| 3,196,382 | A | 7/1965 | Morello, Jr. |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,757 | A | 10/1966 | Bonhomme |
| 3,292,136 | A | 12/1966 | Somerset |
| 3,320,575 | A | 5/1967 | Brown et al. |
| 3,348,186 | A | 10/1967 | Rosen |
| 3,350,677 | A | 10/1967 | Daum |
| 3,355,698 | A | 11/1967 | Keller |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,498,647 | A | 3/1970 | Schroder |
| 3,517,373 | A | 6/1970 | Jamon |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,601,776 | A | 8/1971 | Curl |
| 3,629,792 | A | 12/1971 | Dorrell |
| 3,633,150 | A | 1/1972 | Swartz |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,710,005 | A | 1/1973 | French |
| 3,739,076 | A | 6/1973 | Schwartz |
| 3,744,007 | A | 7/1973 | Horak |
| 3,778,535 | A | 12/1973 | Forney, Jr. |
| 3,781,762 | A | 12/1973 | Quackenbush |
| 3,781,898 | A | 12/1973 | Holloway |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,030,798 | A | 6/1977 | Paoli |
| 4,046,451 | A | 9/1977 | Juds et al. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,125,308 | A | 11/1978 | Schilling |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,280,749 | A | 7/1981 | Hemmer |
| 4,285,564 | A | 8/1981 | Spinner |
| 4,296,986 | A | 10/1981 | Herrmann et al. |
| 4,307,926 | A | 12/1981 | Smith |
| 4,322,121 | A | 3/1982 | Riches et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |
| 4,408,821 | A | 10/1983 | Forney, Jr. |
| 4,408,822 | A | 10/1983 | Nikitas |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher et al. |
| 4,462,653 | A | 7/1984 | Flederbach et al. |
| 4,464,000 | A | 8/1984 | Werth et al. |
| 4,470,657 | A | 9/1984 | Deacon |
| 4,484,792 | A | 11/1984 | Tengler et al. |
| 4,484,796 | A | 11/1984 | Sato et al. |
| 4,506,943 | A | 3/1985 | Drogo |
| 4,515,427 | A | 5/1985 | Smit |
| 4,525,017 | A | 6/1985 | Schildkraut et al. |
| 4,531,805 | A | 7/1985 | Werth |
| 4,533,191 | A | 8/1985 | Blackwood |
| 4,540,231 | A | 9/1985 | Forney, Jr. |
| RE31,995 | E | 10/1985 | Ball |
| 4,545,637 | A | 10/1985 | Bosshard et al. |
| 4,575,274 | A | 3/1986 | Hayward |
| 4,580,862 | A | 4/1986 | Johnson |
| 4,580,865 | A | 4/1986 | Fryberger |
| 4,583,811 | A | 4/1986 | McMills |
| 4,585,289 | A | 4/1986 | Bocher |
| 4,588,246 | A | 5/1986 | Schildkraut et al. |
| 4,593,964 | A | 6/1986 | Forney, Jr. et al. |
| 4,596,434 | A | 6/1986 | Saba et al. |
| 4,596,435 | A | 6/1986 | Bickford |
| 4,598,961 | A | 7/1986 | Cohen |
| 4,600,263 | A | 7/1986 | DeChamp et al. |
| 4,613,199 | A | 9/1986 | McGeary |
| 4,614,390 | A | 9/1986 | Baker |
| 4,616,900 | A | 10/1986 | Cairns |
| 4,632,487 | A | 12/1986 | Wargula |
| 4,634,213 | A | 1/1987 | Larsson et al. |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |
| 4,660,921 | A | 4/1987 | Hauver |
| 4,668,043 | A | 5/1987 | Saba et al. |
| 4,674,818 | A | 6/1987 | McMills et al. |
| 4,676,577 | A | 6/1987 | Szegda |
| 4,682,832 | A | 7/1987 | Punako et al. |
| 4,684,201 | A | 8/1987 | Hutter |
| 4,688,876 | A | 8/1987 | Morelli |
| 4,688,878 | A | 8/1987 | Cohen et al. |
| 4,691,976 | A | 9/1987 | Cowen |
| 4,703,987 | A | 11/1987 | Gallusser et al. |
| 4,703,988 | A | 11/1987 | Raux et al. |

4,717,355 A 1/1988 Mattis
4,734,050 A 3/1988 Negre et al.
4,734,666 A 3/1988 Ohya et al.
4,737,123 A 4/1988 Paler et al.
4,738,009 A 4/1988 Down et al.
4,746,305 A 5/1988 Nomura
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,806,116 A 2/1989 Ackerman
4,808,128 A 2/1989 Werth
4,813,886 A 3/1989 Roos et al.
4,820,185 A 4/1989 Moulin
4,834,675 A 5/1989 Samchisen
4,835,342 A 5/1989 Guginsky
4,836,801 A 6/1989 Ramirez
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,938,718 A 7/1990 Guendel
4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,432 A 4/1991 Sucht et al.
5,021,010 A 6/1991 Wright
5,024,606 A 6/1991 Ming-Hwa
5,030,126 A 7/1991 Hanlon
5,037,328 A 8/1991 Karlovich
5,062,804 A 11/1991 Jamet et al.
5,066,248 A 11/1991 Gaver, Jr. et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,154,636 A 10/1992 Vaccaro et al.
5,161,993 A 11/1992 Leibfried, Jr.
5,166,477 A 11/1992 Perin, Jr. et al.
5,181,161 A 1/1993 Hirose et al.
5,186,501 A 2/1993 Mano
5,186,655 A 2/1993 Glenday et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,393 A 6/1993 Del Negro et al.
5,227,587 A 7/1993 Paterek
5,247,424 A 9/1993 Harris et al.
5,269,701 A 12/1993 Leibfried, Jr.
5,283,853 A 2/1994 Szegda
5,284,449 A 2/1994 Vaccaro
5,294,864 A 3/1994 Do
5,295,864 A 3/1994 Birch et al.
5,316,494 A 5/1994 Flanagan et al.
5,318,459 A 6/1994 Shields
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawaguchi et al.
5,393,244 A 2/1995 Szegda
5,413,504 A 5/1995 Kloecker et al.
5,431,583 A 7/1995 Szegda
5,435,745 A 7/1995 Booth
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday
5,683,263 A 11/1997 Hse
5,702,263 A 12/1997 Baumann et al.
5,722,856 A 3/1998 Fuchs et al.
5,746,617 A 5/1998 Porter, Jr. et al.
5,746,619 A 5/1998 Harting et al.
5,769,652 A 6/1998 Wider
5,775,927 A 7/1998 Wider
5,863,220 A 1/1999 Holliday
5,877,452 A 3/1999 McConnell
5,879,191 A 3/1999 Burris
5,882,226 A 3/1999 Bell et al.
5,921,793 A 7/1999 Phillips
5,938,465 A 8/1999 Fox, Sr.
5,944,548 A 8/1999 Saito
5,957,716 A 9/1999 Buckley et al.
5,967,852 A 10/1999 Follingstad et al.
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,042,422 A 3/2000 Youtsey

| | | | |
|---|---|---|---|
| 6,048,229 | A | 4/2000 | Lazaro, Jr. |
| 6,053,777 | A | 4/2000 | Boyle |
| 6,089,903 | A | 7/2000 | Stafford Gray et al. |
| 6,089,912 | A | 7/2000 | Tallis et al. |
| 6,089,913 | A | 7/2000 | Holliday |
| 6,123,567 | A | 9/2000 | McCarthy |
| 6,146,197 | A | 11/2000 | Holliday et al. |
| 6,152,753 | A | 11/2000 | Johnson et al. |
| 6,153,830 | A | 11/2000 | Montena |
| 6,210,222 | B1 | 4/2001 | Langham et al. |
| 6,217,383 | B1 | 4/2001 | Holland et al. |
| 6,239,359 | B1 | 5/2001 | Lilienthal, II et al. |
| 6,241,553 | B1 | 6/2001 | Hsia |
| 6,261,126 | B1 | 7/2001 | Stirling |
| 6,271,464 | B1 | 8/2001 | Cunningham |
| 6,331,123 | B1 | 12/2001 | Rodrigues |
| 6,332,815 | B1 | 12/2001 | Bruce |
| 6,358,077 | B1 | 3/2002 | Young |
| D458,904 | S | 6/2002 | Montena |
| D460,739 | S | 7/2002 | Fox |
| D460,740 | S | 7/2002 | Montena |
| D460,946 | S | 7/2002 | Montena |
| D460,947 | S | 7/2002 | Montena |
| D460,948 | S | 7/2002 | Montena |
| 6,422,900 | B1 | 7/2002 | Hogan |
| 6,425,782 | B1 | 7/2002 | Holland |
| D461,166 | S | 8/2002 | Montena |
| D461,167 | S | 8/2002 | Montena |
| D461,778 | S | 8/2002 | Fox |
| D462,058 | S | 8/2002 | Montena |
| D462,060 | S | 8/2002 | Fox |
| D462,327 | S | 9/2002 | Montena |
| 6,468,100 | B1 | 10/2002 | Meyer et al. |
| 6,491,546 | B1 | 12/2002 | Perry |
| D468,696 | S | 1/2003 | Montena |
| 6,506,083 | B1 | 1/2003 | Bickford et al. |
| 6,530,807 | B2 | 3/2003 | Rodrigues et al. |
| 6,540,531 | B2 | 4/2003 | Syed et al. |
| 6,558,194 | B2 | 5/2003 | Montena |
| 6,572,419 | B2 | 6/2003 | Feye-Homann |
| 6,576,833 | B2 | 6/2003 | Covaro et al. |
| 6,619,876 | B2 | 9/2003 | Vaitkus et al. |
| 6,676,446 | B2 | 1/2004 | Montena |
| 6,683,253 | B1 | 1/2004 | Lee |
| 6,692,285 | B2 | 2/2004 | Islam |
| 6,712,631 | B1 | 3/2004 | Youtsey |
| 6,716,062 | B1 | 4/2004 | Palinkas et al. |
| 6,733,337 | B2 | 5/2004 | Kodaira |
| 6,767,248 | B1 | 7/2004 | Hung |
| 6,786,767 | B1 | 9/2004 | Fuks et al. |
| 6,790,081 | B2 | 9/2004 | Burris et al. |
| 6,805,584 | B1 | 10/2004 | Chen |
| 6,817,896 | B2 | 11/2004 | Derenthal |
| 6,848,939 | B2 | 2/2005 | Stirling |
| 6,848,940 | B2 | 2/2005 | Montena |
| 6,884,115 | B2 | 4/2005 | Malloy |
| 6,939,169 | B2 | 9/2005 | Islam et al. |
| 6,971,912 | B2 | 12/2005 | Montena et al. |
| 7,029,326 | B2 | 4/2006 | Montena |
| 7,086,897 | B2 | 8/2006 | Montena |
| 7,097,499 | B1 | 8/2006 | Purdy |
| 7,114,990 | B2 | 10/2006 | Bence et al. |
| 7,118,416 | B2 | 10/2006 | Montena et al. |
| 7,125,283 | B1 | 10/2006 | Lin |
| 7,147,509 | B1 | 12/2006 | Burris et al. |
| 7,229,303 | B2 | 6/2007 | Vermoesen et al. |
| 7,252,546 | B1 | 8/2007 | Holland |
| 7,255,598 | B2 | 8/2007 | Montena et al. |
| 7,393,245 | B2 | 7/2008 | Palinkas et al. |
| 7,476,127 | B1 | 1/2009 | Wei |
| 7,479,035 | B2 | 1/2009 | Bence et al. |
| 7,497,729 | B1 | 3/2009 | Wei |
| 7,507,117 | B2 | 3/2009 | Amidon |
| 7,566,236 | B2 | 7/2009 | Malloy et al. |
| 7,607,942 | B1 * | 10/2009 | Van Swearingen ..... 439/578 |
| 7,674,132 | B1 | 3/2010 | Chen |
| 7,682,177 | B2 | 3/2010 | Berthet |
| 7,727,011 | B2 | 6/2010 | Montena et al. |
| 7,753,705 | B2 | 7/2010 | Montena |
| 7,806,725 | B1 | 10/2010 | Chen |
| 7,811,133 | B2 * | 10/2010 | Gray ..... 439/607.41 |
| 7,824,216 | B2 * | 11/2010 | Purdy ..... 439/578 |
| 7,828,595 | B2 | 11/2010 | Mathews |
| 7,833,053 | B2 | 11/2010 | Mathews |
| 7,845,976 | B2 | 12/2010 | Mathews |
| 7,845,978 | B1 | 12/2010 | Chen |
| 7,850,487 | B1 | 12/2010 | Wei |
| 7,892,005 | B2 | 2/2011 | Haube |
| 7,892,024 | B1 | 2/2011 | Chen |
| 2002/0013088 | A1 | 1/2002 | Rodrigues et al. |
| 2002/0038720 | A1 | 4/2002 | Kai et al. |
| 2003/0214370 | A1 | 11/2003 | Allison et al. |
| 2004/0077215 | A1 | 4/2004 | Palinkas et al. |
| 2004/0102089 | A1 | 5/2004 | Chee |
| 2004/0209516 | A1 | 10/2004 | Burris et al. |
| 2004/0219833 | A1 | 11/2004 | Burris et al. |
| 2004/0229504 | A1 | 11/2004 | Liu |
| 2005/0042919 | A1 | 2/2005 | Montena |
| 2005/0208827 | A1 | 9/2005 | Burris et al. |
| 2006/0110977 | A1 | 5/2006 | Mathews |
| 2006/0154519 | A1 | 7/2006 | Montena |
| 2008/0102696 | A1 | 5/2008 | Montena |
| 2009/0098770 | A1 | 4/2009 | Bence et al. |
| 2010/0081322 | A1 | 4/2010 | Malloy et al. |
| 2010/0297871 | A1 | 11/2010 | Haube |
| 2010/0297875 | A1 | 11/2010 | Purdy |
| 2011/0021072 | A1 | 1/2011 | Purdy |
| 2011/0053413 | A1 | 3/2011 | Mathews |

FOREIGN PATENT DOCUMENTS

| | | | |
|---|---|---|---|
| CN | 201149936 | Y | 11/2008 |
| CN | 201149937 | Y | 11/2008 |
| CN | 201178228 | Y | 1/2009 |
| DE | 47931 | C | 10/1888 |
| DE | 102289 | C | 4/1899 |
| DE | 1117687 | B | 11/1961 |
| DE | 1191880 | | 4/1965 |
| DE | 1515398 | B1 | 4/1970 |
| DE | 2225764 | A1 | 12/1972 |
| DE | 2221936 | A1 | 11/1973 |
| DE | 2261973 | A1 | 6/1974 |
| DE | 3211008 | A1 | 10/1983 |
| DE | 9001608.4 | U1 | 4/1990 |
| EP | 116157 | A1 | 8/1984 |
| EP | 167738 | A2 | 1/1986 |
| EP | 0072104 | A1 | 2/1986 |
| EP | 0265276 | A2 | 4/1988 |
| EP | 0428424 | A2 | 5/1991 |
| EP | 1191268 | A1 | 3/2002 |
| EP | 1501159 | A1 | 1/2005 |
| EP | 1701410 | A2 | 9/2006 |
| FR | 2232846 | A1 | 1/1975 |
| FR | 2234680 | A2 | 1/1975 |
| FR | 2312918 | | 12/1976 |
| FR | 2462798 | A1 | 2/1981 |
| FR | 2494508 | A1 | 5/1982 |
| GB | 589697 | A | 6/1947 |
| GB | 1087228 | A | 10/1967 |
| GB | 1270846 | A | 4/1972 |
| GB | 1401373 | A | 7/1975 |
| GB | 2019665 | A | 10/1979 |
| GB | 2079549 | A | 1/1982 |
| GB | 2252677 | A | 8/1992 |
| GB | 2264201 | A | 8/1993 |
| GB | 2331634 | A | 5/1999 |
| JP | 3280369 | B2 | 5/2002 |
| KR | 200610062526 | B1 | 9/2006 |
| TW | 427044 | B | 3/2001 |
| WO | 8700351 | | 1/1987 |
| WO | 0186756 | A1 | 11/2001 |
| WO | 2004013883 | A2 | 2/2004 |
| WO | 2006081141 | A1 | 8/2006 |

OTHER PUBLICATIONS

Caro, E.R. et al. Breakdown-Resistant RF Connectors for Vacuum. NASA Tech Brief vol. 11, No. 6, Item #63. Jet Propulsion Laboratory, California Institute of Technology, Pasadena CA. Jul. 1987. 5 pages.

*PCT International, Inc.*, v. *John Mezzalingua Associates, Inc.*; U.S. District Court District of Delaware (Wilmington); Civil Docket for Case #: 1:10-cv-00059-LPS. No decision yet.
*John Mezzalingua Associates, Inc.*, v. *PCT International, Inc.*; U.S. District Court Western District of Texas (San Antonio); Civil Docket for Case #: 5:09-cv-00410-WRF. No decision yet. Defendant's Answer to Plaintiffs First Amended Complaint, Affirmative Defenses and Counterclaims. pp. 1-53.
*John Mezzalingua Associates, Inc.*, v. *PCT International, Inc.*; U.S. District Court Western District of Texas (San Antonio); Civil Docket for Case #: 5:09-cv-00410-WRF. No decision yet. Expert Report of Barry Grossman (Redacted). 61 pages.
*John Mezzalingua Associates, Inc.*, v. *PCT International, Inc.*; U.S. District Court Western District of Texas (San Antonio); Civil Docket for Case #: 5:09-cv-00410-WRF. No decision yet. Defendant/Counterclaimant PCT International, Inc.'s First Supplemental Answers and Objections to Plaintiff/Counterclaim Defendant John Mezzalingua Associates, Inc. D/B/A PPC's Amended Second Set of Interrogatories (Nos. 4-17). pp. 1-11.
*John Mezzalingua Associates, Inc.*, v. *PCT International, Inc.*; U.S. District Court Western District of Texas (San Antonio); Civil Docket for Case #: 5:09-cv-00410-WRF. No decision yet. Defendant's Response and Objections to Plaintiff's Amended Second Set of Interrogatories (Nos. 4-17). pp. 1-20.
Digicon AVL Connector. Arris Group Inc. [online]. 3 pages. [retrieved on Apr. 22, 2010]. Retrieved from the Internet< URL: http://www.arrisi.com/special/digiconAVL.asp>.
PCT/US2010/029581, International Application Filing Date Apr. 1, 2010. International Search Report and Written Opinion, Date of Mailing Oct. 22, 2010. 9 pages.

* cited by examiner

COAXIAL CABLE CONNECTOR WITH IMPROVED PHYSICAL AND RF SEALING

CROSS-REFERENCE TO RELATED APPLICATIONS

This application claims the priority benefit of U.S. Provisional Patent Application No. 61/165,508 filed Apr. 1, 2009, and entitled COAXIAL CABLE CONNECTOR WITH IMPROVED PHYSICAL AND RFI SEALING.

FIELD OF THE INVENTION

The present invention relates to coaxial cable connectors, such as, for example, F-type coaxial cable connectors used in coaxial cable communication applications, and more specifically to coaxial cable connector structure sealing against ingress of physical environmental contaminants and providing improved torque engagement of the RF seal of such connectors against standard coaxial cable connector interface ports.

BACKGROUND OF THE INVENTION

Broadband communications have become an increasingly prevalent form of electromagnetic information exchange and coaxial cables are common conduits for transmission of broadband communications. Connectors for coaxial cables are typically connected onto complementary interface ports to electrically integrate coaxial cables to various electronic devices and cable communication equipment. Connection is often made through rotatable operation of an internally threaded nut of the connector about a corresponding externally threaded interface port. Fully tightening the threaded connection of the coaxial cable connector to the interface port, typically through application of operable torque, helps ensure abutment of connector components against the port and ensure RF sealing of components of the connector against complimentary components of the interface port. However, often connectors are not properly installed to the interface port. The connector may not be fully tightened to the interface port, so that proper electrical mating of connector components with the interface port does not occur. Once tightened, the connector may loosen causing loss of component abutment and RF sealing. The cable connection may also be faulty because the connector is over-tightened onto the interface port causing connector components to yield and/or move out of proper physical and RF sealing connection with the interface port. Furthermore, common connectors do not facilitate both RF sealing and also physical sealing against ingress of physical environmental contaminants that may enter the connector and cause a faulty connection or otherwise hinder connector performance. Hence a need exists for an improved connector for sealing against ingress of physical environmental contaminants and for providing improved engagement of the RF seal of the connector against a standard coaxial cable connector interface port.

SUMMARY OF THE INVENTION

A first aspect of the present invention provides an F-type coaxial cable connector comprising: a connector body, having a first end and a second end; a post, attached to the connector body; a threaded nut, rotatable with respect to the post and also axially movable with respect to the connector body between a first position and a second position; a biasing member, internally located axially and radially within the nut, the biasing member compressably operable to exert force on the nut tending the nut to move in a direction toward the second end of the connector body; and a joint stop element, located to operably interact with the biasing member and introduce obstructive structure that impedes axial movement of the nut; wherein the nut is movable in an axial direction toward the first end of the connector body when in a first position; and wherein when the nut is located in a second position it is no longer movable in a direction toward the first end of the connector body, because the obstructive structure of the joint stop element physically impedes further movement of the nut.

A second aspect of the present invention provides an F-type coaxial cable connector for coupling a coaxial cable to an interface port, the coaxial cable including a center conductor surrounded by a dielectric material, the dielectric material being surrounded by an outer conductive grounding shield, the outer conductive grounding shield surrounded by a protective outer jacket, the F-type coaxial cable connector comprising in combination: a connector body, having a first end and a second end, the second end configured to deformably compress against and seal a received coaxial cable; a post, axially securely attached to the connector body, the post having a first end and a second end, the first end of the post including a flange and the second end of the post configured to be inserted into an end of the received coaxial cable around the dielectric and under at least one layer the conductive grounding shield thereof; a threaded nut, rotatable with respect to the post and also axially movable with respect to the connector body between a first position and a second position; a biasing member, the biasing member compressably operable to exert force on the nut tending the nut to move in a direction toward the second end of the connector body; a fastener member, including an internal ramped surface, the fastener member operable to deformably compress the outer surface of the connector body to axially secure the received coaxial cable between the connector body and the fastener member; and a joint stop element, including obstructive structure of a component of the connector that is axially movable with respect to the received and secured cable and including obstructive structure of a component that is not movable with respect to the received and secured cable; wherein the obstructive structure of the movable component with respect to the cable contacts the obstructive structure of the non-axially-movable component with respect to the cable when the nut is in a second position to impede axial movement of the nut in a direction toward the first end of the connector body.

A third aspect of the present invention provides a coaxial cable connector comprising: a connector body; a post, attached to the connector body; a threaded nut, rotatable with respect to the post and also axially movable with respect to the connector body between a first position and a second position; a biasing member, operable to exert force on the nut to move the nut; and means for impeding axial movement of the nut in one axial direction, when the nut resides in the second position; wherein the means remain structurally sound during the buildup of axial force applied thereto, as threadable rotational torque is exerted when the nut is tightened into mating with a corresponding interface port, through operation of a wrench; and wherein the means prevent the connector from experiencing structural and functional deformation because the movement impediments of the means prevent the biasing member from being over-compressed causing connector components to yield and thus not properly function during repetitive use.

A fourth aspect of the present invention provide a method of extending an RF grounding shield from a coaxial cable to a cable interface port, the method comprising: providing a coaxial cable connector to connect the coaxial cable to the interface port, the coaxial cable connector comprising: a connector body, having a first end and a second end; a post, attached to the connector body and operable to receive the coaxial cable; a threaded nut, rotatable with respect to the post and also axially movable with respect to the connector body between a first position and a second position; a biasing member, operable to exert force on the nut tending the nut to move in a direction toward the second end of the connector body; a fastener member, including an internal ramped surface, the fastener member operable to deformably compress the outer surface of the connector body to axially secure the received coaxial cable between the connector body and the fastener member; and a joint stop element, located to interact with the biasing member and introduce obstructive structure that impedes axial movement of the nut; wherein the nut is movable in an axial direction toward the first end of the connector body when in a first position; and wherein the nut is not movable in a direction toward the first end of the connector body when in a second position, because the obstructive structure of the joint stop element physically impedes further movement of the nut; rotating the nut to thread the nut onto the interface port a distance sufficient for the post of the connector to contact the port, wherein the position of the connector structure when the post initially contacts the port corresponds to a first position; advancing and tightening the nut further onto the port to ensure electrical contact between a mating edge of the port and a mating edge of the post, wherein, as the nut advances onto the port it axially slidably moves with respect to the post and connector body in a direction toward the first end of the connector body, so that the associated biasing member exerts resultant force to drive the post into firm contact with the interface port; and impeding further axial movement of the nut with respect to the post and the connector body, by bottoming out the movement of the nut through operation of obstructive structure of the joint stop element so that the bottoming out of the movement of the nut corresponds to a second position, wherein the nut is no longer axially movable in a direction toward the first end of the connector body.

The foregoing and other features of construction and operation of the invention will be more readily understood and fully appreciated from the following detailed disclosure, taken in conjunction with accompanying drawings.

DETAILED DESCRIPTION

Although certain embodiments of the present invention are shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of embodiments of the present invention.

As a preface to the detailed description, it should be noted that, as used in this specification and the appended claims, the singular forms “a”, “an” and “the” include plural referents, unless the context clearly dictates otherwise.

Figure 1:
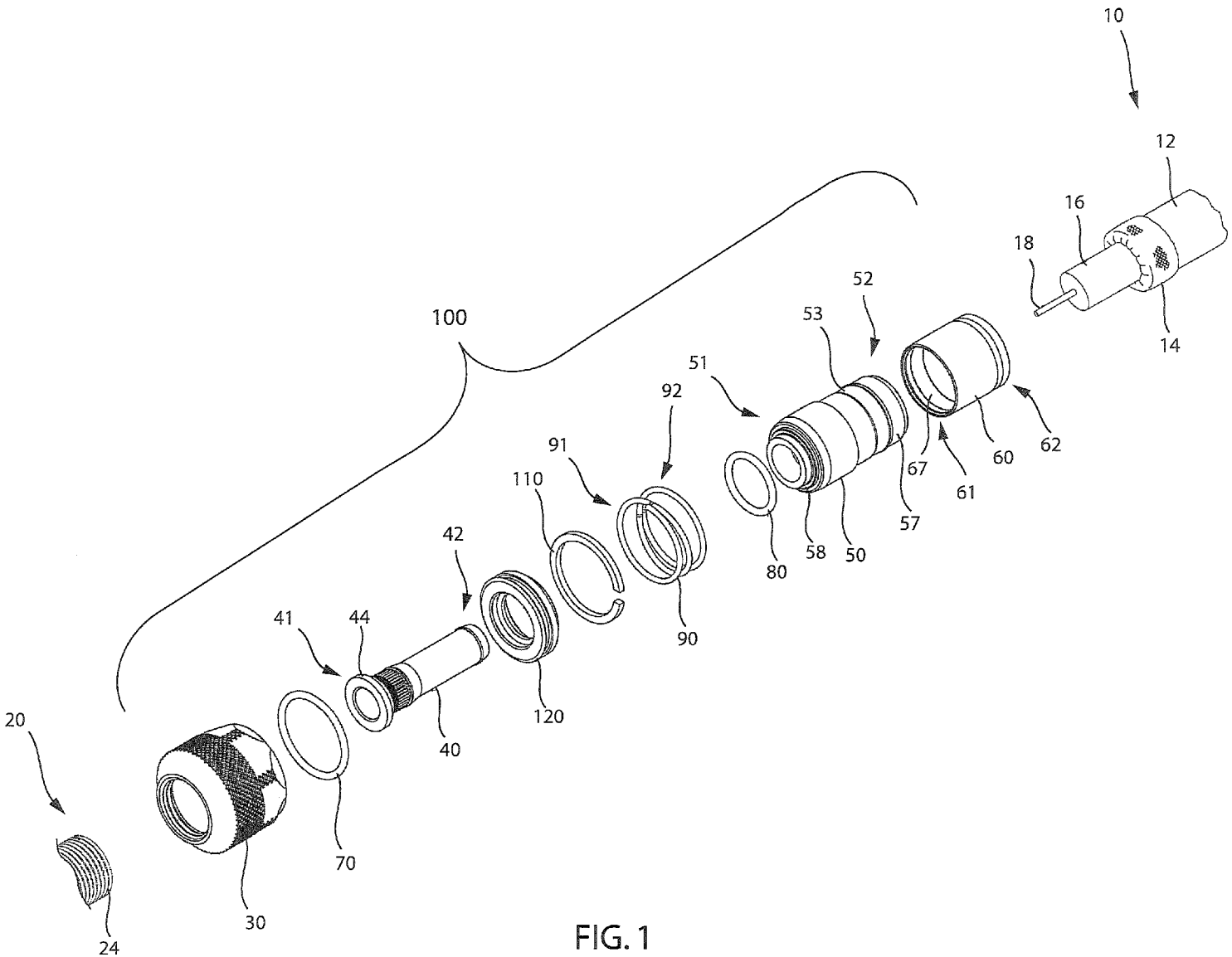
FIG. 1 depicts an exploded perspective view of embodiments of the elements of an embodiment of a coaxial cable connector, in accordance with the present invention.

Referring to the drawings, FIG. 1 depicts one embodiment of a coaxial cable connector 100. The coaxial cable connector 100 may be operably affixed to a coaxial cable 10 having a protective outer jacket 12, a conductive grounding shield 14, an interior dielectric 16 and a center conductor 18. The coaxial cable 10 may be prepared as embodied in FIG. 1 by removing the protective outer jacket 12 and drawing back the conductive grounding shield 14 to expose a portion of the interior dielectric 16. Further preparation of the embodied coaxial cable 10 may include stripping the dielectric 16 to expose a portion of the center conductor 18. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 may be comprised of conductive materials suitable for providing an electrical ground connection. Various embodiments of the shield 14 may be employed to screen unwanted noise. For instance, the shield 14 may comprise a metal foil layer wrapped around the dielectric 16, or several conductive strands formed in a continuous braid layer around the dielectric 16. Combinations of multiple layers of foil and/or braided strands may be utilized wherein the conductive shield 14 may comprise a foil layer, then a braided layer, and then a foil layer. Those in the art will appreciate that various layer combinations may be implemented in order for the conductive grounding shield 14 to effectuate an electromagnetic buffer helping to prevent ingress of environmental noise that may disrupt broadband communications. The dielectric 16 may be comprised of materials suitable for electrical insulation. It should be noted that the various materials of which all the various components of the coaxial cable 10 are comprised may have some degree of elasticity allowing the cable 10 to flex or bend in accordance with traditional coaxial cable communications standards, installation methods and/or equipment. It should further be recognized that the radial thickness of the coaxial cable 10, protective outer jacket 12, conductive grounding shield 14, interior dielectric 16 and/or center conductor 18 may vary based upon generally recognized parameters corresponding to coaxial cable communication standards and/or equipment.

Referring further to FIG. 1, the connector 100 may also include a coaxial cable interface port 20. The coaxial cable interface port 20 includes a conductive receptacle 22 (shown in FIG. 5) for receiving a portion of a coaxial cable center conductor 18 sufficient to make adequate electrical contact. The coaxial cable interface port 20 may further comprise a threaded exterior surface 24. In addition, the coaxial cable interface port 20 may comprise a mating edge 26 (also shown in FIG. 5). It should be recognized that the radial thickness and/or the length of the coaxial cable interface port 20 and/or the conductive receptacle 22 may vary based upon generally recognized parameters corresponding to coaxial cable communication standards and/or equipment. Moreover, the pitch and height of threads which may be formed upon the threaded exterior surface 24 of the coaxial cable interface port 20 may also vary based upon generally recognized parameters corresponding to coaxial cable communication standards and/or equipment. Furthermore, it should be noted that the interface port 20 may be formed of a single conductive material, multiple conductive materials, or may be configured with both conductive and non-conductive materials corresponding to the port's 20 operable electrical interface with a connector 100. However, the conductive receptacle 22 should be formed of a conductive material. Further still, it will be understood by those of ordinary skill that the interface port 20 may be embodied by a connective interface component of a coaxial cable communications device, a television, a modem, a computer port, a network receiver, or other communications modifying devices such as a signal splitter, a cable line extender, a cable network module and/or the like.

Referring still further to FIG. 1, an embodiment of a coaxial cable connector 100 may further comprise a threaded nut 30, a post 40, a connector body 50, a fastener member 60, a nut sealing member 70, such as, for example, an nut O-ring, a connector body sealing member 80, such as, for example, a body O-ring, a biasing member 90, such as, for example, a coil spring, a spring stop member 110, such as, for example, a split ring washer, and a seal spacer 120. Various component features of a coaxial cable connector 100, such as a spring stop member 110, may work in combination with other features of the connector 100 and comprise a joint stop element 115, as will be described in greater detail in reference to FIGS. 4 and 5.

Figure 2:
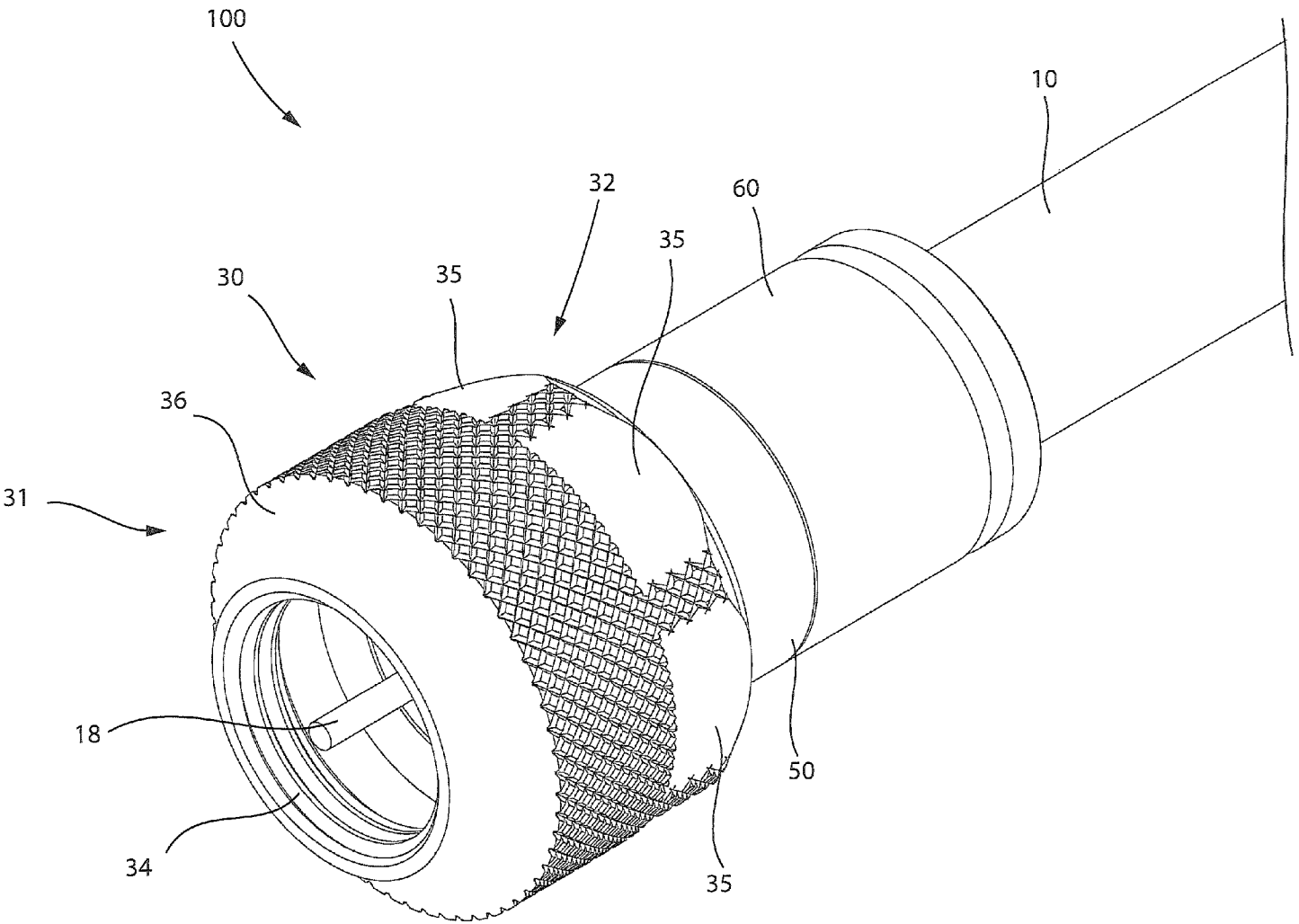
FIG. 2 depicts a perspective view of an embodiment of a coaxial cable connector attached to a coaxial cable, in accordance with the present invention.
Figure 4:
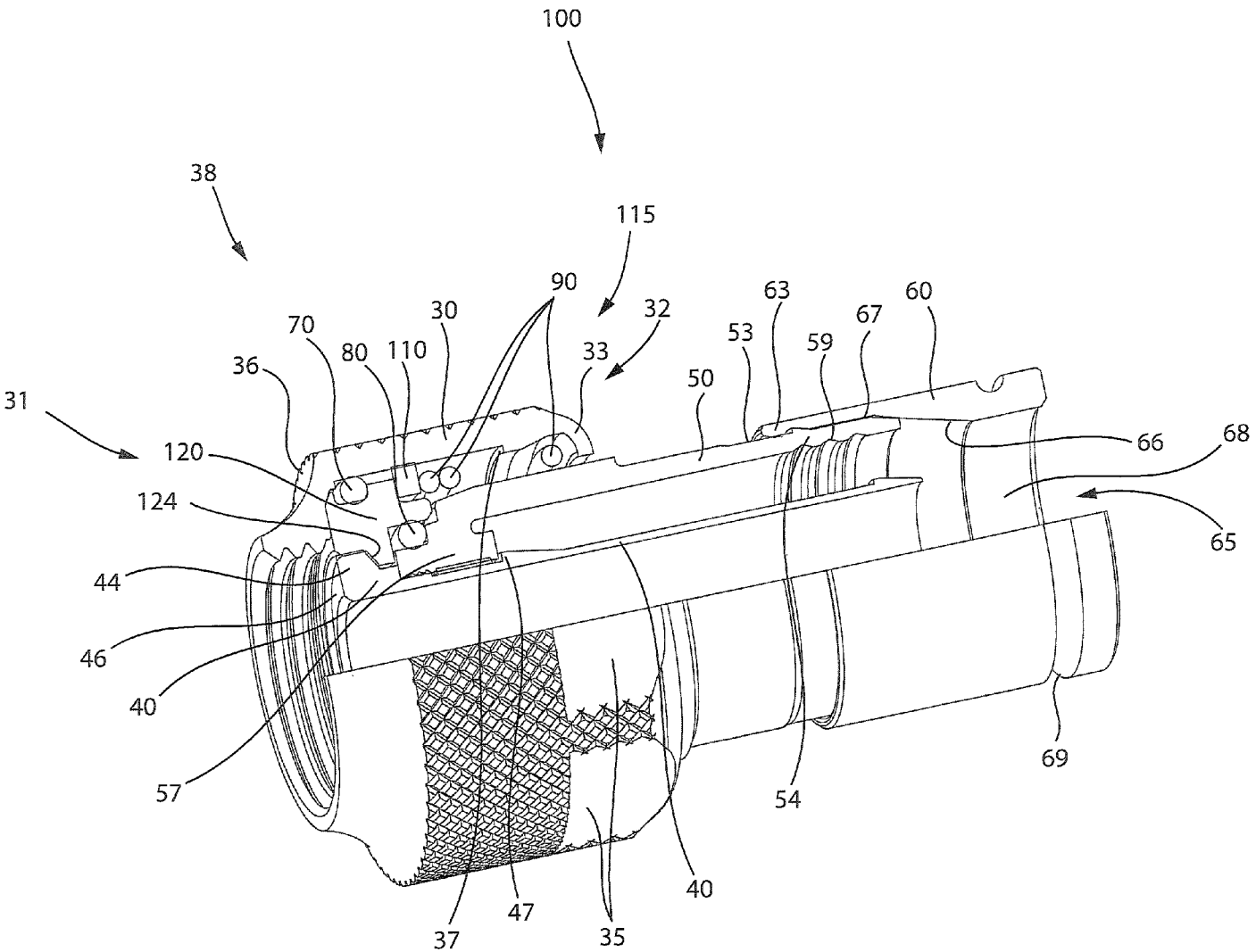
FIG. 4 depicts a perspective cut-away view of an embodiment of a coaxial cable connector in a first position, in accordance with the present invention.
Figure 5:
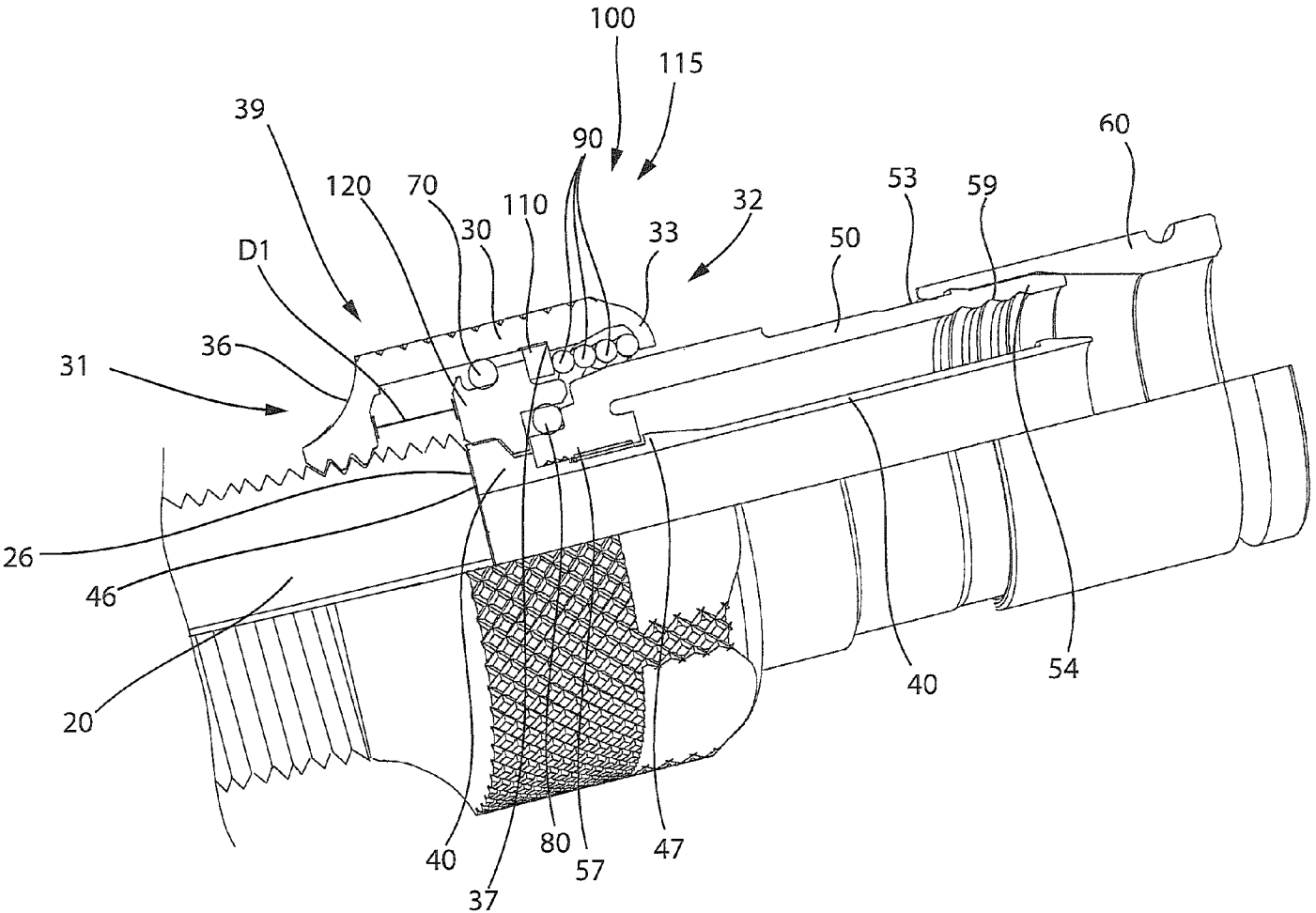
FIG. 5 depicts a side cut-away view of an embodiment of a coaxial cable connector in a second position as attached to an interface port, in accordance with the present invention.

With additional reference to the drawings, FIG. 2 depicts a perspective view of an embodiment of a connector 100 attached to a coaxial cable 100 The connector 100 includes a threaded nut 30 having a first end 31 and opposing second end 32. The threaded nut 30 may comprise an port seal surface feature 36 located on the external portion of the nut 30 proximate the first end 31 and configured to facilitate mating of a port seal 136 (shown in FIG. 3) to help seal the connector 100 against ingress of unwanted environmental contaminants. Furthermore, the threaded nut 30 may comprise internal threading extending axially from the edge of first end 31 a distant sufficient to provide sufficient threadable contact with the external threads 24 of a standard coaxial cable interface port 20 (as shown in FIGS. 1 and 5). The threaded nut 30 may include an internal stop feature 37 (as shown in FIGS. 4 and 5). The threaded nut 30 may also include hex flats 35 located on an external surface of the nut 30. The hex flats 35 may be located proximate the second end 32 of the nut and may facilitate operable engagement of a tool, such as a wrench, that may be utilized to tighten the nut 30 onto an interface port 20. It should be appreciated that operation of a tool, such as a wrench, may offer mechanical advantage over hand-tightening. Hence, engagement of the tool upon the hex flats 35 may afford the ability to apply more torque when installing the connector 100 on an interface port, than hand-tightening. The nut 30 may further include a radially inward extending skirt 33 located at the second end 32 of the nut. The skirt 33 may include an annular portion, which may have a thickness that is less than that of the major portion of the body of the nut 30. The skirt 33 may initially have an inside diameter equal to that of the rest of the internal surface proximate the second end 32 of the body of the nut 30. However, to facilitate operability of the connector 100, the skirt 33 should eventually be fashioned to bend or otherwise extend radially inward toward the center axis of the connector 100. When assembled, the threaded nut 30 is rotatable with respect to the post 40 and the connector body 50 of an embodiment of a coaxial cable connector 100.

A biasing member 90, such as a spring, may be configured such that a surface of the spring biasing member 90 is internally located axially and radially within the nut 30. For instance, the spring biasing member 90 may be position within the internal portion of the nut 30 when the elements are assembled as shown in FIG. 4. After spring biasing member 90 is positioned within the internal portion of the nut 30, the annular skirt 33 may be peened over, i.e., deformed, from a possible initial, straight configuration to a bent configuration shown in FIG. 4, wherein, as depicted, the connector 100 structure is in a first position 38. As described later in more detail with respect to FIGS. 4 and 5, the nut 30 may be moved axially relative to the other elements of the connector 100, such as the connector body 50, causing compression of biasing member 90 between an inner surface of skirt 33 and a spring stop member 110 of the coaxial cable connector 100. The nut 30 and all portions thereof may be axially movable with respect to a received and secured coaxial cable 10, shown in FIGS. 2-3. The threaded nut 30 may be formed of conductive materials facilitating grounding through the nut. Accordingly the nut 30 may be configured to extend an electromagnetic buffer by electrically contacting conductive surfaces of an interface port 20 when a connector 100 (shown in FIG. 5) is advanced onto the port 20. In addition, the threaded nut 30 may be formed of non-conductive material and function only to physically secure and advance a connector 100 onto an interface port 20. Moreover, the threaded nut 30 may be formed of both conductive and non-conductive materials. For example the external surface of the nut 30 may be formed of a polymer, while the remainder of the nut 30 may be comprised of a metal or other conductive material. In addition, portions of the threaded nut 30 may be formed of metals or polymers or other materials that would facilitate a rigidly formed body. Manufacture of the threaded nut 30 may include casting, extruding, cutting, knurling, turning, tapping, drilling, bending, peening, crimping, injection molding, blow molding, or other fabrication methods that may provide efficient production of the component.

Figure 3:
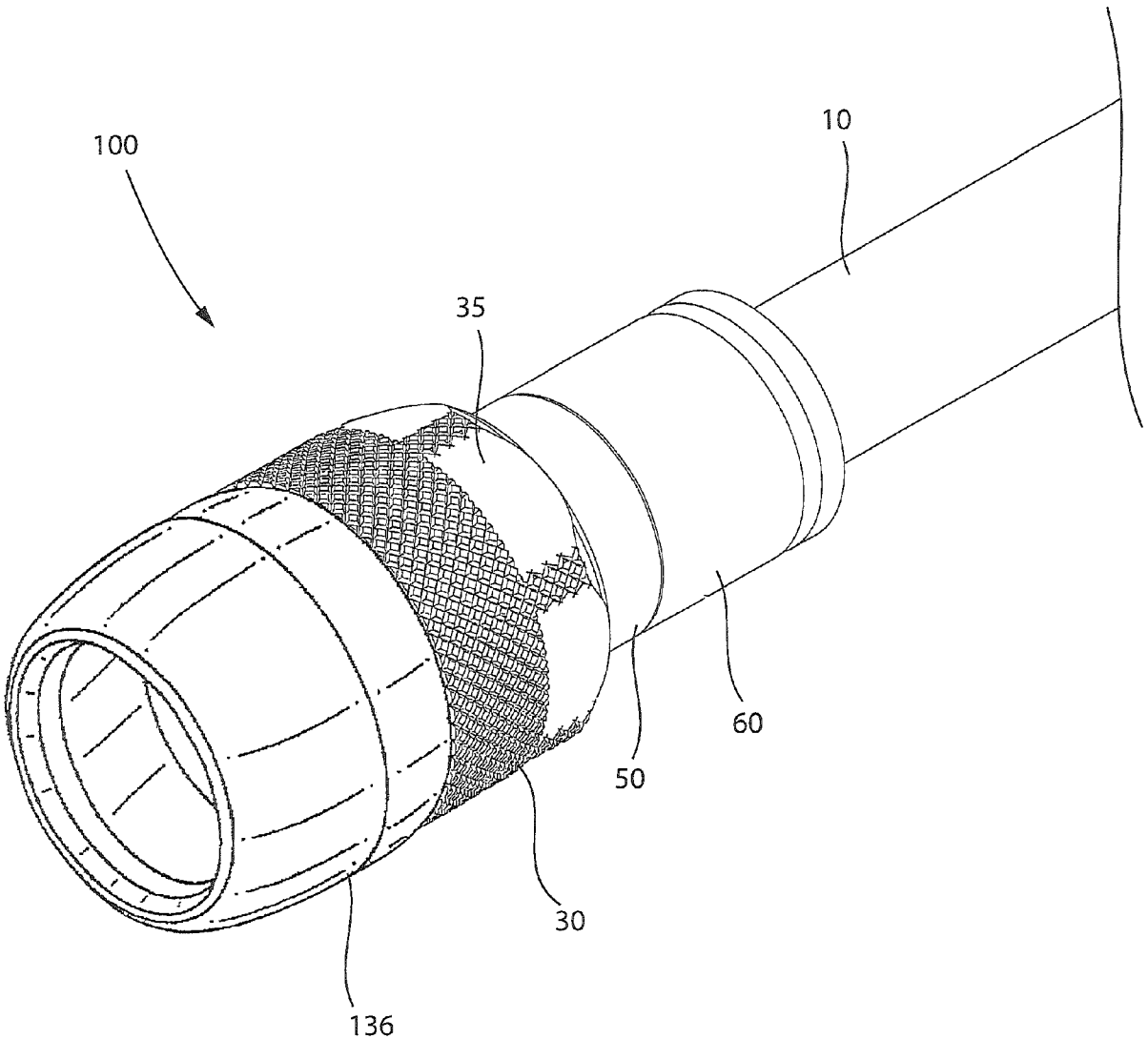
FIG. 3 depicts a perspective view of an embodiment of a coaxial cable connector attached to a coaxial cable and operable with a port seal, in accordance with the present invention.

The port seal, shown in FIG. 3, may be formed of soft plastic, rubber, elastomeric polymer, or other materials that have properties allowing the port seal to tightly conform to and mate with the port seal surface feature 36 of the nut. For example, FIG. 3 depicts a perspective view of an embodiment of a connector 100 attached to a coaxial cable 10 and operable with a port seal 136 mated to or otherwise sealingly engaged with the nut 30.

Referring still to FIGS. 1-3, and additionally to FIG. 4, an embodiment of a connector 100 may include a post 40. The post 40 comprises a first end 41 and opposing second end 42. Furthermore, the post 40 may comprise a flange 44 operatively configured to contact a corresponding lip 124 of a seal spacer 120 thereby facilitating the prevention of axial movement of the post in the direction of the seal spacer 120. Further still, an embodiment of the post 40 may include an external surface feature 47 such as a lip or protrusion that may engage a portion of a connector body 50 to secure axial movement of the post 40 relative to the connector body 50. Additionally, the post 40 may include a mating edge 46. The mating edge 46 may be configured to make physical and electrical contact with a corresponding mating edge 26 (see FIG. 5) of an interface port 20. The post 40 should be formed such that portions of a prepared coaxial cable 10 including the dielectric 16 and center conductor 18 (shown in FIG. 1) may pass axially into the second end 42 and/or through a portion of the tube-like body of the post 40. Moreover, the post 40 should be dimensioned such that the post 40 may be inserted into an end of the prepared coaxial cable 10, around the dielectric 16 and under the protective outer jacket 12 and conductive grounding shield 14. Accordingly, where an embodiment of the post 40 may be inserted into an end of the prepared coaxial cable 10 under the drawn back conductive grounding shield 14, substantial physical and/or electrical contact with the shield 14 may be accomplished thereby facilitating grounding through the post 40. The post 40 may be formed of metals or other conductive materials that would facilitate a rigidly formed post body. In addition, the post 40 may be formed of a combination of both conductive and non-conductive materials. For example, a metal coating or conductive outer layer may be applied to an inner polymer core made of other non-conductive material. Manufacture of the post 40 may include casting, extruding, cutting, turning, drilling, injection molding, spraying, blow molding, or other fabrication methods that may provide efficient production of the component.

Embodiments of a coaxial cable connector, such as connector 100, may include a connector body 50. The connector body 50 may comprise a first end 51 and opposing second end 52. Moreover, the connector body may include a post mounting portion 57 proximate the first end 51 of the body 50, the post mounting portion 57 configured to mate and achieve purchase with a portion of the outer surface of post 40, so that the connector body 50 is axially secured to the post 40. The external surface feature 47 of the post 40 may serve to hinder axial movement of the body 50 once mounted on the post 40. In addition, the connector body 50 may include an outer annular recess 58 located proximate the first end 51. Furthermore, the connector body 50 may include a semi-rigid, yet compliant outer surface 54, wherein the outer surface 54 may be configured to form an annular seal when the second end 52 is deformably compressed against a received coaxial cable 10 by operation of a fastener member 60. The connector body 50 may include an external annular detent 53 located proximate the second end 52 of the connector body 50. Further still, the connector body 50 may include internal surface features 59, such as annular serrations formed on the internal surface of the body proximate the second end 52 and configured to enhance frictional restraint and gripping of an inserted and received coaxial cable 10. The connector body 50 may be formed of materials such as, plastics, polymers, bendable metals or composite materials that facilitate a semi-rigid, yet compliant outer surface 54. Further, the connector body 50 may be formed of conductive or non-conductive materials or a combination thereof. Manufacture of the connector body 50 may include casting, extruding, cutting, turning, drilling, bending, injection molding, spraying, blow molding, or other fabrication methods that may provide efficient production of the component.

With further reference to FIGS. 1-4, embodiments of a coaxial cable connector 100 may include a fastener member 60. The fastener member 60 may have a first end 61 and opposing second end 62. In addition, the fastener member 60 may include an internal annular protrusion 63 located proximate the first end 62 of the fastener member 60 and configured to mate and achieve purchase with the annular detent 53 on the outer surface 54 of connector body 50 (shown in FIG. 1). Moreover, the fastener member 60 may comprise a central passageway 65 defined between the first end 61 and second end 62 and extending axially through the fastener member 60. The central passageway 65 may comprise a ramped surface 66 which may be positioned between a first opening or inner bore 67 having a first diameter positioned proximate with the first end 61 of the fastener member 60 and a second opening or inner bore 68 having a second diameter positioned proximate with the second end 62 of the fastener member 60. The ramped surface 66 may compressably act to deformably compress the outer surface 54 of a connector body 50 when the fastener member 60 is operated to secure a received coaxial cable 10. FIGS. 2 and 3 depict a coaxial cable 10 compressably secured to an embodiment of a connector 100 through deformation caused by operation of the fastener member 60. Once secured, the cable 10 may be axially immovable with respect to the post 40, the connector body 50, the nut sealing member 70, the body sealing member 80, the spring stop member 110, and the seal spacer 120. Additionally, the fastener member 60 may comprise an exterior surface feature 69 positioned proximate with the second end 62 of the fastener member 60. The surface feature 69 may facilitate gripping of the fastener member 60 during operation of the connector 100. Although the surface feature is shown as an annular detent, it may have various shapes and sizes such as a ridge, notch, protrusion, knurling, or other friction or gripping type arrangements. It should be recognized, by those skilled in the requisite art, that the fastener member 60 may be formed of rigid materials such as metals, hard plastics, polymers, composites and the like. Furthermore, the fastener member 60 may be manufactured via casting, extruding, cutting, turning, drilling, injection molding, spraying, blow molding, or other fabrication methods that may provide efficient production of the component.

As depicted in FIG. 4, the nut 30 of the embodied coaxial cable connector 100 is in a first position 38. When the connector 100 structure is in a first position 38, the nut 30 may be free to move axially toward the first end 51 of the connector body 50. Or, in other words, the nut is free to move toward in an axial direction toward the interface port, in relation to other connector 100 components. In addition, when the connector 100 structure is in a first position, the nut 30 may be partially moved toward the first end 51 of the connector body 50 and the internally located biasing member 90 may be partially compressed, because the nut 30 is still free to move further toward the first end 51 of the connector body 50.

Turning now to FIG. 5, an embodiment of a connector 100 is shown in a side cut-away view, wherein the connector 100 structure is in a second position 39, as attached to an externally threaded coaxial cable interface port 20. When the connector 100 structure is in a second position 39, the nut 30 is not free to move axially toward the first end 51 of the connector body 50. In other words, the nut 30 is no longer able to threadably advance in a direction towards and onto the interface port 20, in relation to other connector 100 components. The movement of the nut 30 toward the first end 51 of the connector body 50 may be impeded by obstructive structure corresponding to a joint stop element 115. The joint stop element 115 includes physical components of a coaxial cable connector 100 that are configured and located to interact in a manner that prevents movement of the nut 30 in a direction toward the first end 51 of the connector body 50. The joint stop element 115 includes component features that interact with the biasing member 90. For example, the joint stop member 115 may comprise the spring stop member 110 being operably sized and located to abut the internal stop feature 37 of the nut, when the biasing member 90 has been compressed and the nut 30 has been moved to a second position 39. This abutment or contact of the spring stop member 110 against the internal stop feature 37 of the nut 30 constitutes a bottoming out of the nut 30; the nut 30 can no longer move in a direction toward the first end 51 of the connector body 50, because the spring stop member 110 and the internal stop feature 37 comprise obstructive structure of the joint stop element 115 and physically impede further movement of the nut. As such, the joint stop element 115 is located to interact with the biasing member 90 and introduce obstructive structure that impedes axial movement of the nut 30. The joint stop element 115 includes obstructive structure of a component of the connector 100, such as the nut 30, that is axially movable with respect to a received and secured cable 10 (see FIGS. 2-3) and also includes obstructive structure of a component that is not movable with respect to the received and secured cable, such as the post 40, the connector body 50, the nut sealing member 70, the body sealing member 80, the spring stop member 110, and/or the seal spacer 120. With regard to a joint stop element 115, the obstructive structure of the movable component with respect to the cable, such as the internal stop feature 37 of the nut 30, contacts the obstructive structure of the non-axially-movable component with respect to the cable, such as the spring stop member 110, when the nut 30 is in a second position 39, to impede axial movement of the nut 30 in a direction toward the first end 51 of the connector body 50.

When a structure of a coaxial cable connector 100 is in the second position 39, as shown in FIG. 5, the connector 100 may also be threadably installed, engaged, and/or otherwise mated with the interface port 20. In FIG. 5, nut 30 has been operably rotated onto the interface port 20, thereby moving connector 100 axially upon the port 20 and bringing the mating edge 26 of the port 20 into contact with the mating edge 46 of flange 44 of post 40. When an installer rotates the connector nut 30 until it is threadably engaged with the port 20 in a manner that abuts the mating edge 26 of the port 20 with the mating edge 46 of the post 40, the conductive contact of port 20 with the post 40 provides ensured RF shielding and substantially eliminates both noise ingress and egress and signal degradation for a connector 100. Furthermore, a more secure physical connection may be obtained, in the sense that the nut 30 is threadably engaged over a longer axial portion of the external threads 24 of the port 20, by continued threadable rotation of nut 30 until the connector structure 100 obtains the second position 39. As depicted in a fully installed configuration shown in FIG. 5, the nut 30 of the connector 100 has moved upon the port 20 by a distance indicated as D1. Other elements of connector 100, besides the nut 30, do not move relative to the port 20, when the connector is operably installed such that the mating face 46 of the post 40 is driven to mate and abut against the mating face of the port 20, as assisted by biasing force exerted by the at least partially compressed biasing member 90. The axial distance by which the nut 30 has moved between FIGS. 4 and 5, i.e., the distance D1 relative to the change in position of the nut between a first position 38 and the second non-compressed position 39, is the distance by which biasing spring member 90 has been compressed.

As the nut 30 travels axially on the port 20, spring stop member 110 bears against a first end 91 end of the bias spring member 90 and compresses the spring member 90 as the other second end 92 of the spring member 90 is held stationary against the inner surface skirt 33 of the nut 30. It is apparent that, as nut 30 is rotated to remove it from the port 20, the elements will move in reverse order as spring member 90 returns to its rest position corresponding to a first position 38. It is apparent that only a very small amount of axial travel of nut 30 on port 20, i.e., an amount produced by only a few revolutions of the nut 30, is required to bring the mating edge 26 of the port 20 into physical and/or electrical contact with mating edge surface 46 of post 40.

Coaxial cable connector 100 embodiments may include means for impeding axial movement of the nut in one axial direction, when the nut resides in the second position. Such means may be the combined obstructive structure of a joint stop element 115. Hence, because the obstructive structure, such as an internal stop feature 37 of the nut 30 in operable conjunction with a spring stop member 110, is sized and located to be sufficient to durably and repetitively handle contact forces associated with typical installation torque and even significant over-torquing, the means remain structurally sound during the buildup of axial force applied to the connector 100 components during installation, as threadable rotational torque is exerted when the nut is tightened into mating with a corresponding interface port, through operation of a wrench. Moreover, because the obstructive structure, such as the operable contact of the internal stop feature 37 of the nut 30 with the spring stop member 110, hinders movement of the nut 30 beyond a set point, the means prevent the connector 100 from experiencing structural and functional deformation because the movement impediments of the means prevent the biasing member 90 from being over-compressed causing connector 100 components to yield and thus not properly function during repetitive use.

As the nut 30 travels with respect to the other connector 100 components, a physical seal may be maintained by operation of the nut sealing member 70 O-ring. The nut sealing member 70 may rest in a pocket or other annular physical feature of a seal spacer 120, so that the nut sealing member 70 is compressed between an inner surface of the nut 30 and the seal spacer 120. In this manner, an enhanced physical barrier is placed between the opening of the nut and the rest of the connector components, connecting with the interface port 20.

In addition a body sealing member 80 may be located in an annular recess 58 positioned at the first end 51 of connector body 50, so that the body sealing member 80 is compressed between the body 50 and a portion of the seal spacer 120. The seal spacer 120 may be locked or otherwise axially secured with respect to the post 40 and connector body 50, by virtue of the corresponding mating components of each of the complimentary connector 100 structural elements. The body sealing member 80 may provide a further physical barrier preventing the ingress of unwanted environmental contaminants into the coaxial cable connector 100.

Embodiments of a coaxial cable connector 100 may offer improved torque engagement with a corresponding coaxial cable interface port 20. An internal stop feature 37 of the nut 30 may operate with the spring stop member 110, as a joint stop element 115, to limit axial movement of the nut 30 with respect to the other components of the connector 100. For example, when the nut has advanced onto an interface port 20 a distance D1, or when the nut has otherwise been compressed toward the first end 51 of connector body 50 a distance D1, the spring stop member 110 may abut, contact, or otherwise become physically impeded by the internal stop feature 37 of the threaded nut 30. In this manner travel of the nut 30 and also compression of the spring biasing member 90 may be managed. The biasing member 90 is compressably operable to exert force on the nut 30 tending the nut 30 to move in a direction toward the second end 52 of the connector body 50. The internal stop feature 37 of the nut 30 provides a shelf or other physical impediment for the spring stop member 110 to bottom on. The combined obstructive structure of the joint stop element 115, can handle, or otherwise remain structurally sound during the buildup of axial force applied thereto, as threadable rotational torque is exerted when the connector nut 30 is tightened into mating with the interface port 20, through operation of a tool, such as a wrench. Those in the art should appreciate that the wrench may be an ordinary wrench sized to match the dimension of the hex flats 35 of the threaded nut 30. Therefore, the spring stop member 110 in operable association with the internal stop feature 37 of the nut 30 may prevent the spring biasing member 90 from being over-compressed causing connector 100 components to yield and thus not properly function during repetitive use. The impeded progress of the nut 30 afforded by the joint stop element 115, because of the obstructive interaction between the spring stop member 110 and the internal stop feature 37 of the nut 30, may correspond to a physical condition associated with tightening torque in compliance with industry standard torque and optimal performance of the coaxial cable connector 100.

The coaxial cable connector 100 creates its RF seal during installation upon an interface port 20, with variability in how tight or loose the installation connection is. This is because the biasing member 90 acts to drive the post 40 and other associated connector 100 components as far forward toward the first end 31 of the nut as possible, while the nut 30 is advanced onto the interface port 20, and even when the nut 30 has not been fully tightened onto the interface port 20. Embodiments of the coaxial cable connector 100 are suited for outdoor use having structural sealing elements to prevent ingress of physical environmental contaminants. For instance, embodiments may employ a nut sealing member 70, such as an O-ring, inside the nut or coupler. A body sealing member 80 may be employed to further enhance structural sealing of the connector 100. Coaxial cable connector 100 embodiments may also include special external surface geometry, such as the port seal surface feature 36 on the front of the nut 30, to help accommodate mating and seating of external port seals, such as port seal 136 shown in FIG. 3. Furthermore, embodiments of the connector 100 may also include hex flats 35 to help in installation by permitting tools to engage the connector 100 to apply torque and tighten the connector 100 to an interface port 20. In addition, embodiments of the connector 100 include a joint stop element 115 having combined obstructive structure, such as an internal stop feature 37 on the internal portion of the nut 30 that works in conjunction with a spring stop member 110, such as a snap ring, to allow the nut 30 to be tightened to industry standard torque specifications without damage to any of the connector 100 parts. A seal spacer 120 may also be provided to facilitate structural location of various connector 100 components. The spring stop member 110 may comprise a snap ring that operably engages the internal stop feature 37, such as an internal shelf, of the nut 30 to bottom on and prevent further axial movement of the nut 30 toward the first end 51 of the connector body 50, the nut 30 being movable with respect to the connector body 50 and other connector 100 components. The spring stop member 110, in conjunction with the internal stop feature 37 of the nut, can, in combination, work as a joint stop element 115 that obstructs axial movement of the nut 30 with respect to the connector body 50 and can handle the build up of force as the threaded nut 30 of the coaxial cable connector 100 is tightened onto the mating port 120 with a wrench or other tool.

Figure 6:
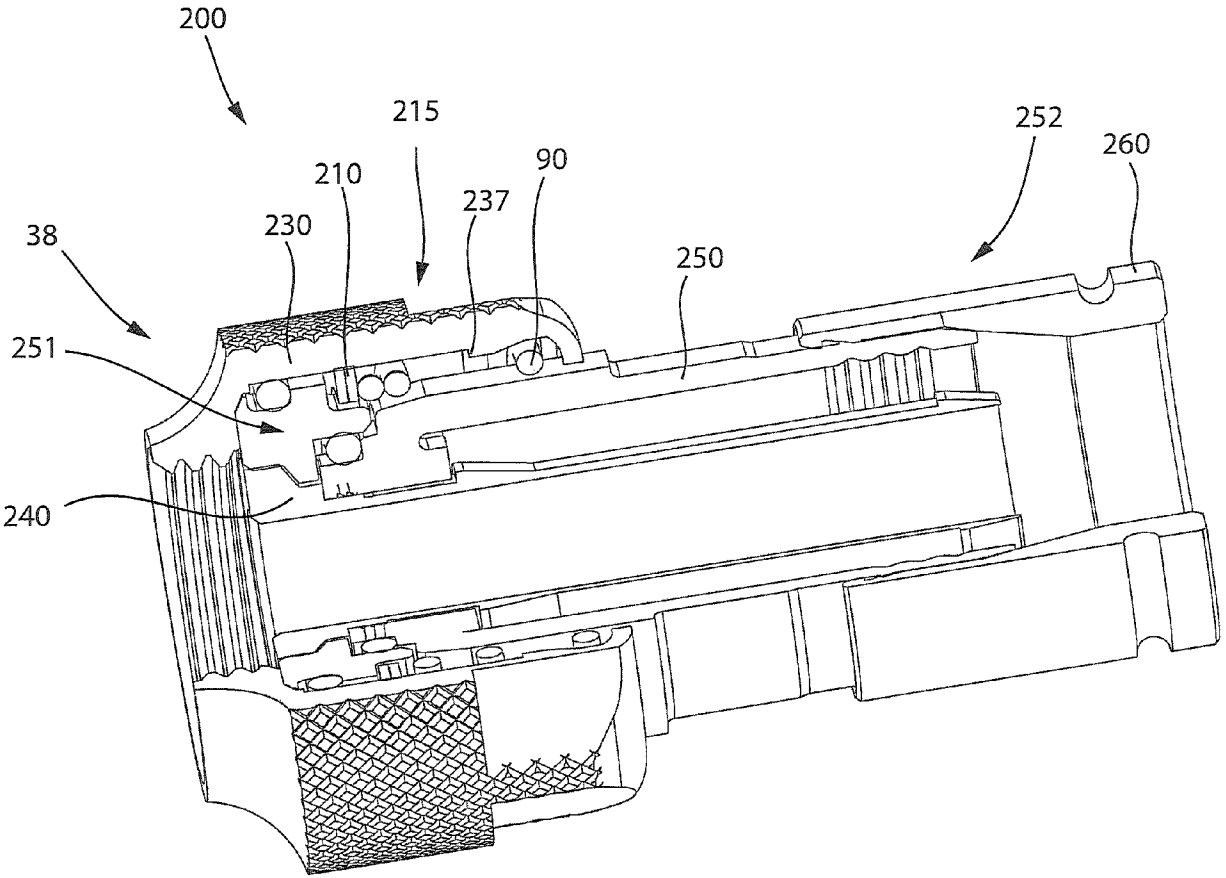
FIG. 6 depicts a perspective cut-away view of another embodiment of a coaxial cable connector also in a first position, in accordance with the present invention.

With further reference to the drawings, FIG. 6 depicts a perspective cut-away view of another embodiment of a connector 200 also in a first position 38. The connector 200 may include a nut 230 operable with a double spring stop member 210, wherein the double spring stop member 210 is positioned within the nut to bottom against an internal stop feature 237. The movement obstructing combination of structure operably associated with the biasing member 90, the double spring stop member 210 and the internal stop feature 237 of the nut 230 comprise a joint stop element 215. The connector 200 structure may bottom out in a second position 39, not shown but similar to the structural configuration of other connector embodiments described and depicted herein. When in a second position 39, the nut 230 of the coaxial cable connector 200 is not movable in a direction toward the first end 251 of the connector body 250 of the connector 200. As depicted, the double spring stop member 210 may comprise two ring washers axially positioned next to one another. An advantage of utilizing ring washers as a spring stop member 210 is that the components are readily available for manufacturing and easily incorporated into assembly processes. One reason two ring washers may be utilized in composition of a spring stop member 210 is to assure that in combination the ring washers will have enough structural integrity to durably resist operative biasing forces associated with the biasing member 90. The coaxial cable connector 200 includes a post 240.

Figure 7:
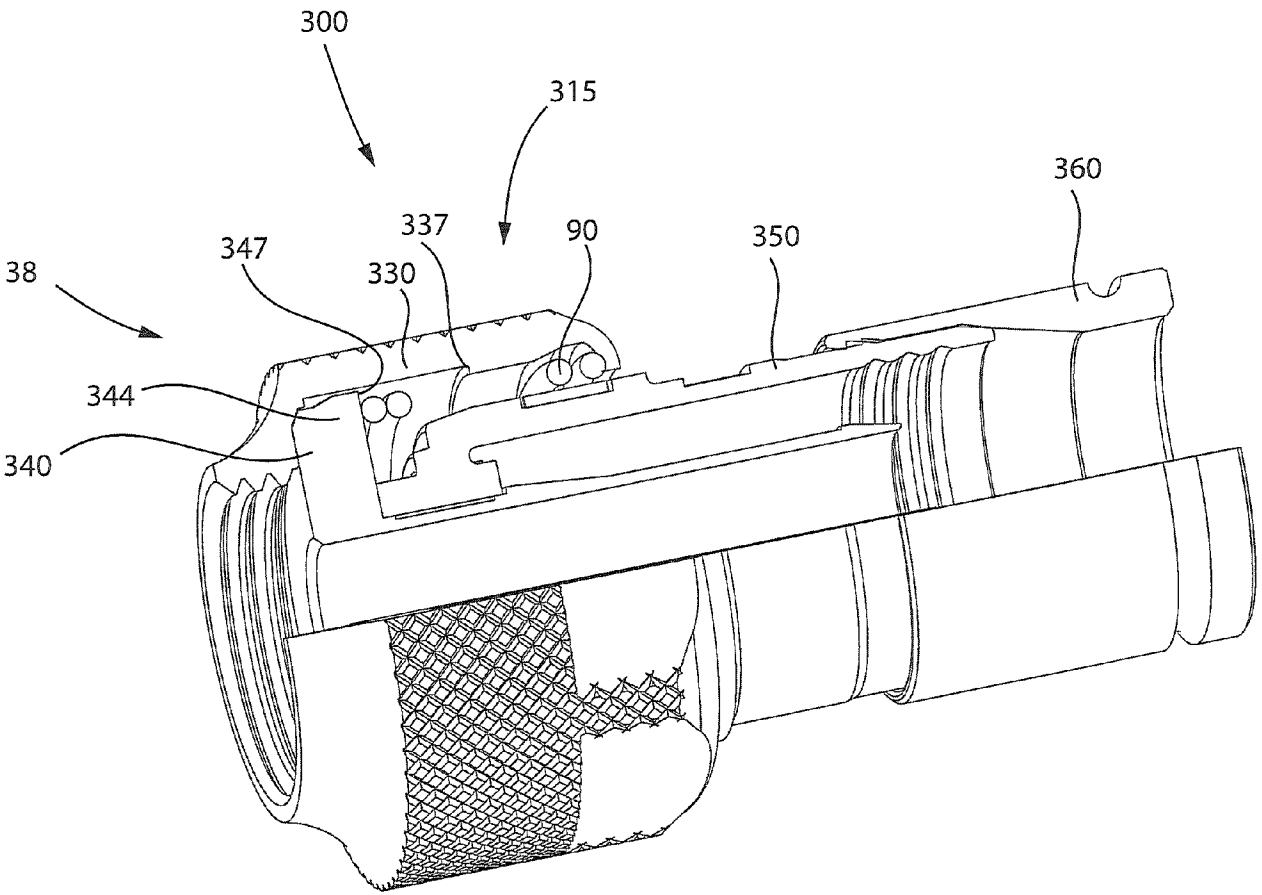
FIG. 7 depicts a perspective cut-away view of a further embodiment of a coaxial cable connector in a first position, in accordance with the present invention.
Figure 8:
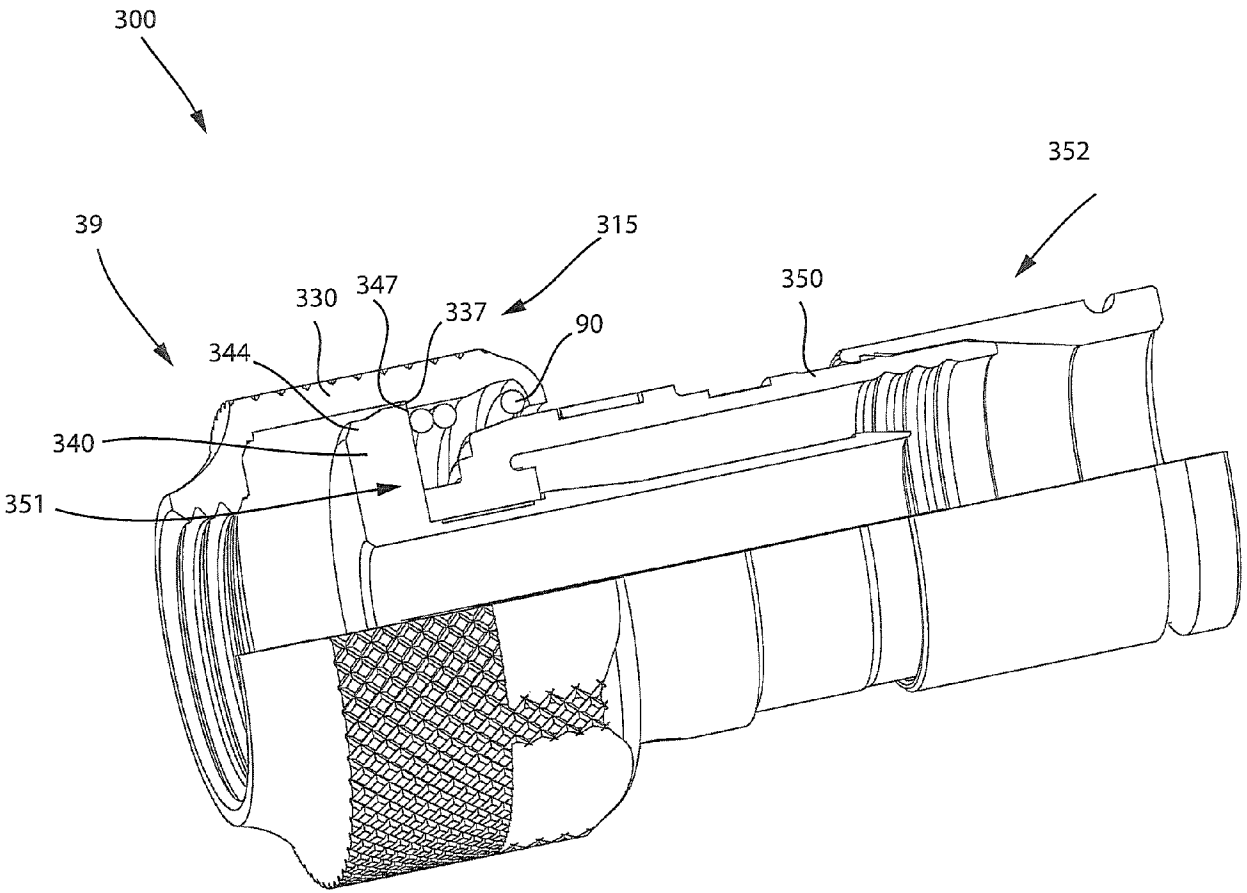
FIG. 8 depicts a perspective cut-away view of the embodiment of the coaxial cable connector of FIG. 7, wherein the connector is in a second position, in accordance with the present invention.

Referring still to the drawings, FIG. 7 depicts a perspective cut-away view of a further embodiment of a connector 300 in a first position 38. The connector 300 may include a post 340 having an enlarged flange 344. The enlarged flange 344 may have an underside 347 and may act and operate like a spring stop member (110, 210), in that the underside 347 of the enlarged flange 344 may abut and bottom against an internal stop feature 337 of a nut 330. Thus, the enlarge flange 344 in operable combination with the internal stop feature 337 of nut 330 as associated with the biasing member 90, provide obstructive structure commensurate with the configuration of a joint stop element 315 that impedes axial movement of the nut 330 in a direction toward the first end 351 of the connector body 350. FIG. 8 depicts the connector 300 in a second position 39, wherein the underside 347 of the flange 344 of post 340 abuts internal stop feature 337. The nut 330 is restricted in axial movement in a direction toward the underside 347 of the flange 344 of the post 340 and toward the first end 351 of connector body 350, when the coaxial cable connector 300 structure resides in a second position 39. An embodiment of a coaxial cable connector 300 having a joint stop element 315 including a post with an enlarged flange 344 serving as a spring stop member 410 operably interactive with a biasing member 90 is advantageous in that no additional stop element components are needed to comprise the movement-obstructive features of the coaxial cable connector 300.

Figure 9:
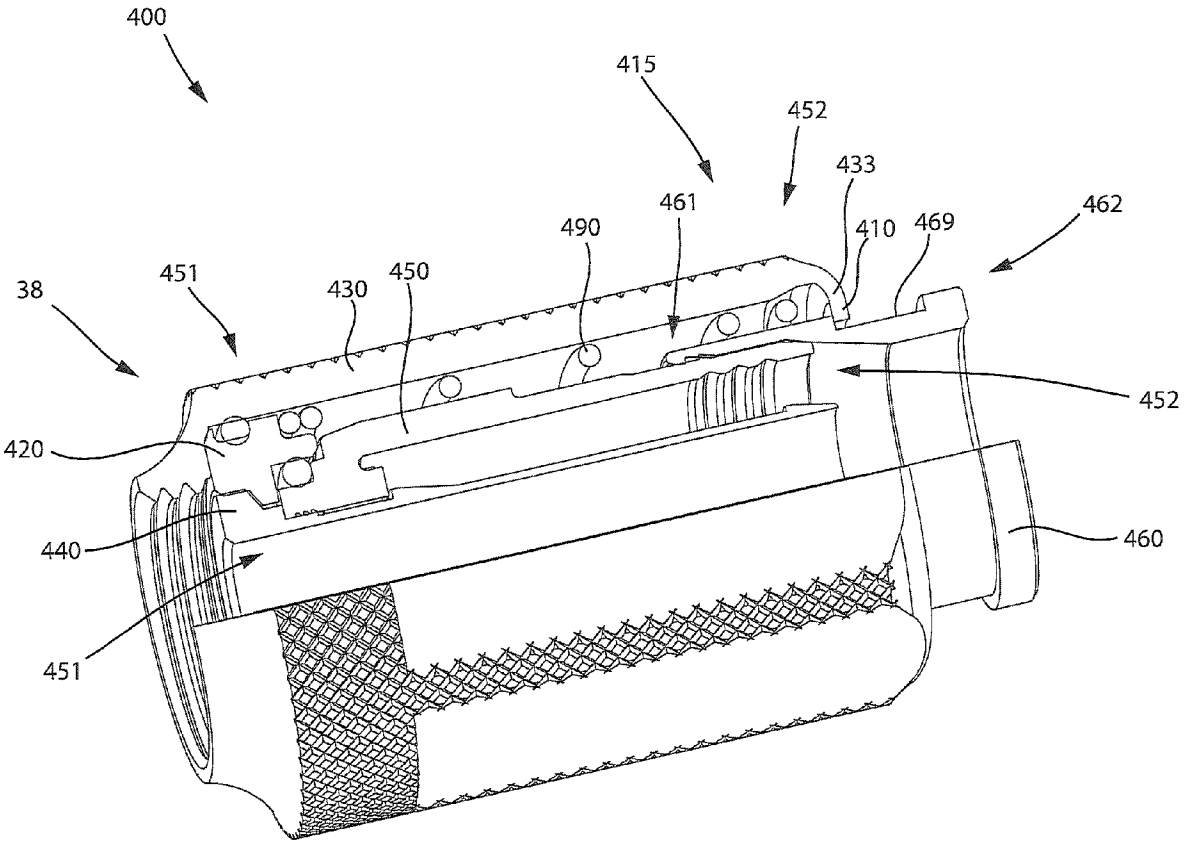
FIG. 9 depicts a perspective cut-away view of a still further embodiment of a coaxial cable connector in a first position, in accordance with the present invention.

With further reference to the drawings, FIG. 9 depicts a perspective cut-away view of a still further embodiment of a connector 400 in a first position 38, having an enlarged nut 430 including a skirt 433, wherein the skirt 433 of the nut 430 operably engages an annular detent 469 of a fastener member 460. The fastener member 460, like the fastener member 60, includes a first end 461 and an opposing second end 462. The detent 469, such as an annular groove, channel, cutout, depression, or slot, may have an axial width sufficient to permit slidable movement of the inwardly facing skirt 433 as it operably engages the detent 469 of the fastener member 460. The biasing member 490 may be a compression spring sized in correspondence with the size of the features of the nut 430. Notably, with regard to embodiments of a coaxial cable connector 400, the nut 430 does not engage, or otherwise contact the connector body 450. This non-body-contacting structure of the nut 430 affords different physical and/or electrical functionality of the coaxial cable connector 400. As depicted in FIG. 9, the coaxial cable connector 400 structure resides in a first position 38, because the nut 430 is movable in a direction toward the first end 451 of the connector body 450, through slidable compressible mounting of the associated fastener member 460 onto the connector body 450 in a direction toward the first end 451 of the connector body 450. The coaxial cable connector 400 includes a post 440.

Figure 10:
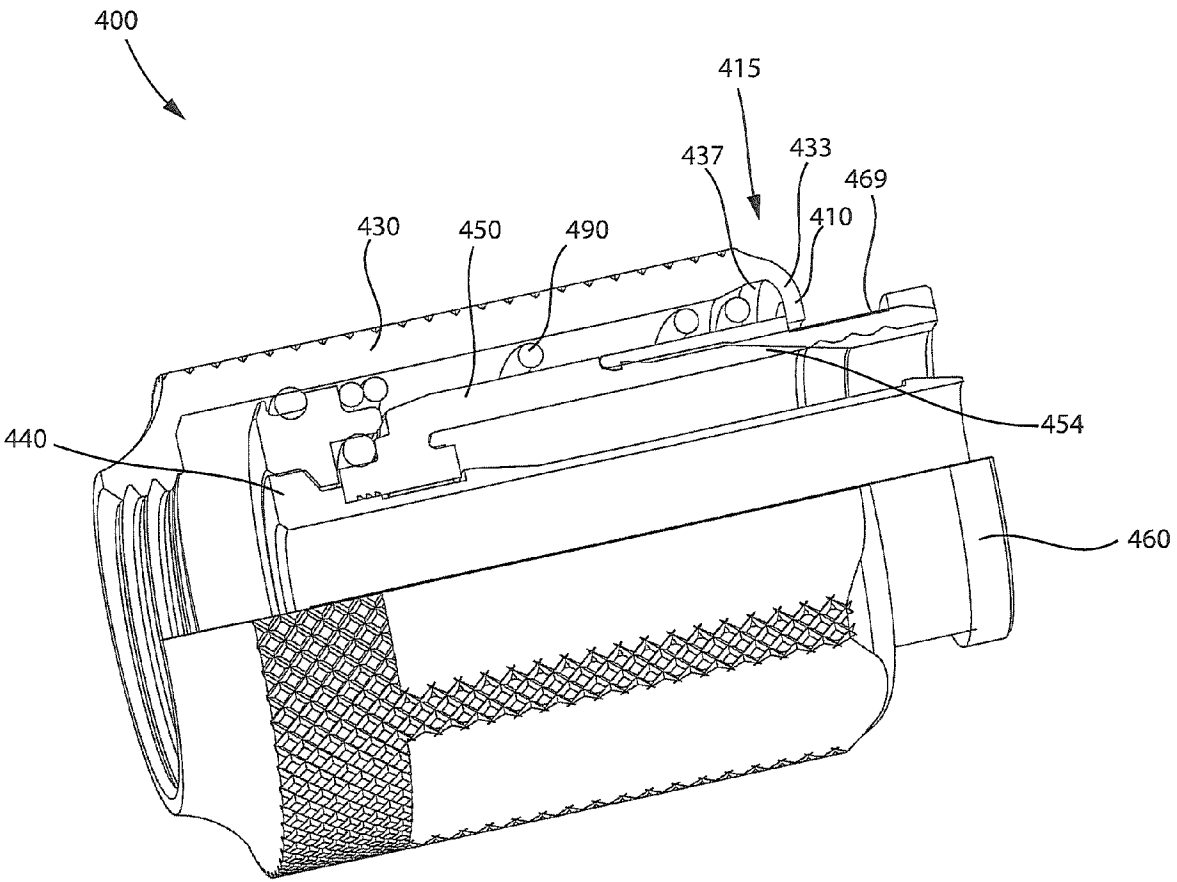
FIG. 10 depicts a perspective cut-away view of the embodiment of the coaxial cable connector of FIG. 9, wherein the connector is in a second position and a fastener member of the connector is maneuvered forward to compress a portion of a connector body, in accordance with the present invention.

FIG. 10 depicts a perspective cut-away view of the embodiment of the connector 400 of FIG. 9, wherein the connector 400 is in a second position 39 and a fastener member 460 of the connector 400 is maneuvered forward to compress a portion 454 of a connector body 450, in accordance with the present invention. Notably, the spring stop member 410 of a coaxial cable connector 400 is the portion of the skirt 433 of the nut 430 that operably engages the external surface feature, such as a detent 469, of the fastener member 460, once the fastener member 460 has been compressed onto the connector body 450, to restrict axial movement of the nut 430 with respect to the first end 451 of the connector body 450. The biasing member 490 may rest upon, interact with, and exert force upon an internal lip 437 of the nut 430. Because the spring stop member 410 is a portion of the skirt 433 of the nut 430 and the internal lip 437 is also a portion of the nut 430, the biasing member interacts with the spring stop member 410. The internal lip 437 may add extra stiffness to withstand the compressive forces of the interactive biasing member. As the movement of the nut 430 is impeded by the abutment of the spring stop member 410 portion of the skirt 433 with the opposing edges of detent 469 in fastener member 460, the operably combined obstructive structure comprise a joint stop member 415. The joint stop element 415 of coaxial cable connector 400 is located to interact with the biasing member 490 and introduce obstructive structure, such as the spring stop member portion 410 of the skirt 433 of the nut 430 in association with the detent 469 of fastener member 460, to impede axial movement of the nut 430.

Figure 11:
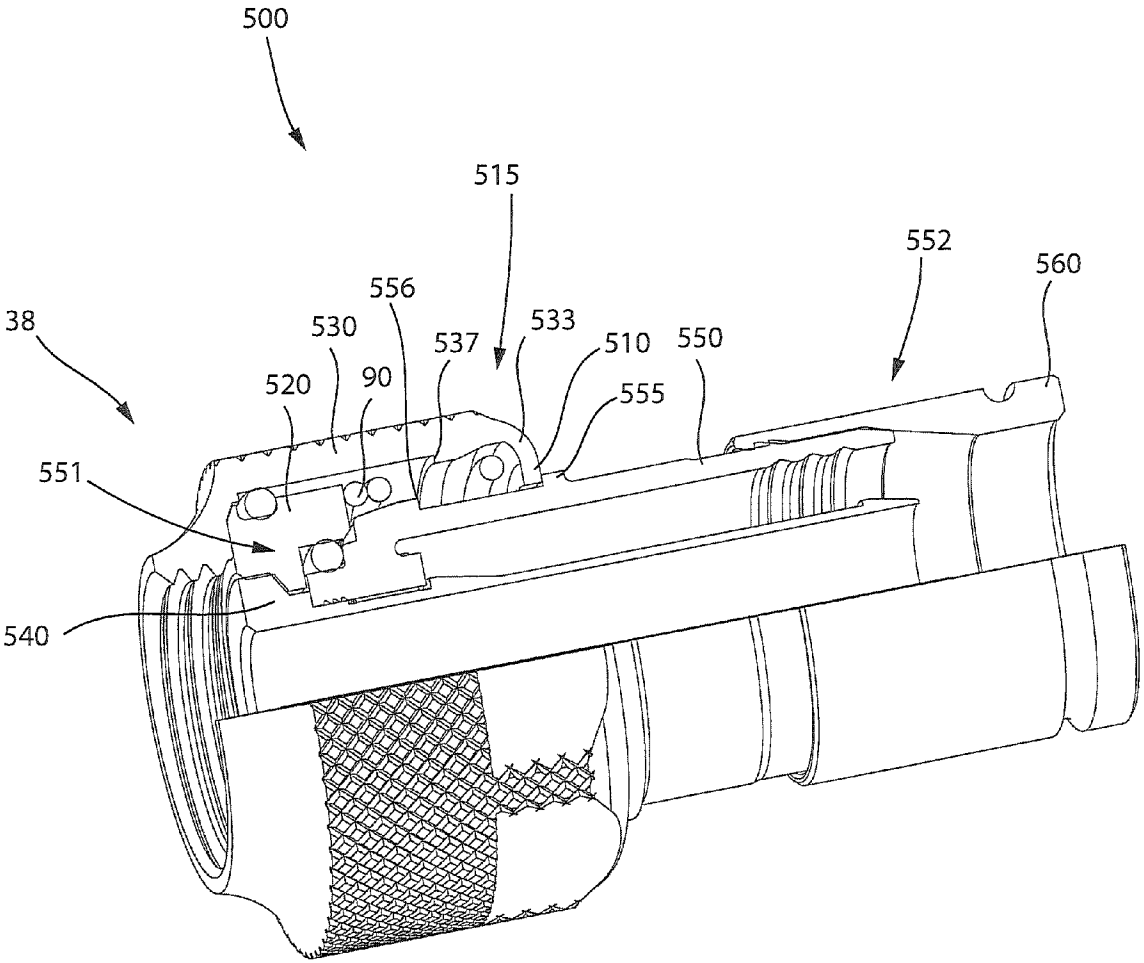
FIG. 11 depicts a perspective cut-away view of an even further embodiment of a coaxial cable connector in a first position, in accordance with the present invention.

FIG. 11 depicts a perspective cut-away view of an even further embodiment of a connector 500 wherein a seal spacer 520 acts like a portion of a spring stop member (110,210) to influence axial movement of the nut 530 by physically interacting with a biasing member 90. A portion of the skirt 533 of the nut 530 slidably engages the connector body 550 and movably operates between a second end 552 external stop feature 555 and a first end 551 external stop feature 556 of the connector body 550. That movement obstructing portion of the skirt 533 of the nut, in cooperation with a seal spacer 520 works in combination as a spring stop member 510. The nut 530 also interacts with the biasing member 90. The external stop feature 555 restricts axial movement of the nut 530 past a point, when the nut 530 is moved in a direction toward the second end 552 of the connector body 550. Likewise the external stop feature 556 restricts axial movement of the nut 530 past another point, when the nut 530 is moved in the opposite direction toward the first end 551 of the connector body 550. The seal spacer 520 and the nut 530 operate with the biasing member 90 to facilitate axial movement of the nut 530 with respect to other components of the coaxial cable connector 500 structure and tending the nut 530 to move in a direction toward the second end 552 of connector body 550. As depicted in FIG. 11, the coaxial cable connector 500 structure is in a first position 38. The coaxial cable connector 500 includes a post 540.

Figure 12:
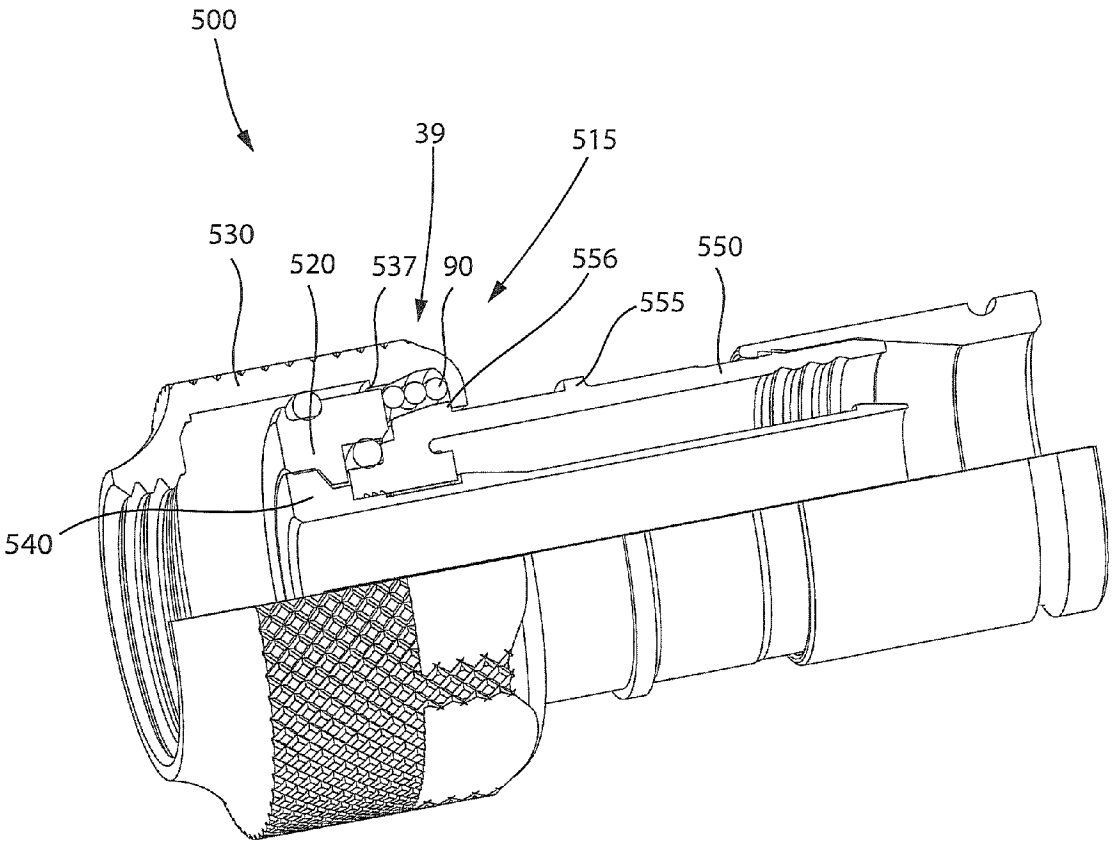
FIG. 12 depicts a perspective cut-away view of the embodiment of the coaxial cable connector of FIG. 11, wherein the connector is in a second position, in accordance with the present invention.

FIG. 12 depicts a perspective cut-away view of the embodiment of the connector 500 of FIG. 11, wherein the connector is in a second position 39, in accordance with the present invention. Notably, the internal stop feature 537 of the nut 530 is not critical to the provision of a joint stop element 515. Rather, the external surface feature 556 protruding from the connector body 550, in operable combination with the spring stop member portion 510 of the skirt 533 of the nut 530, serve as movement impeding structures comprising a joint stop element 515, when the biasing member 90 is compressed and the connector 500 structure is in a second position 39, preventing further travel of the nut 530 toward the first end 551 of the body 550. This is advantageous in that no additional joint stop element component features are required to effectuate proper mating of the coaxial cable connector 500 to a corresponding coaxial cable interface port 20.

Figure 13:
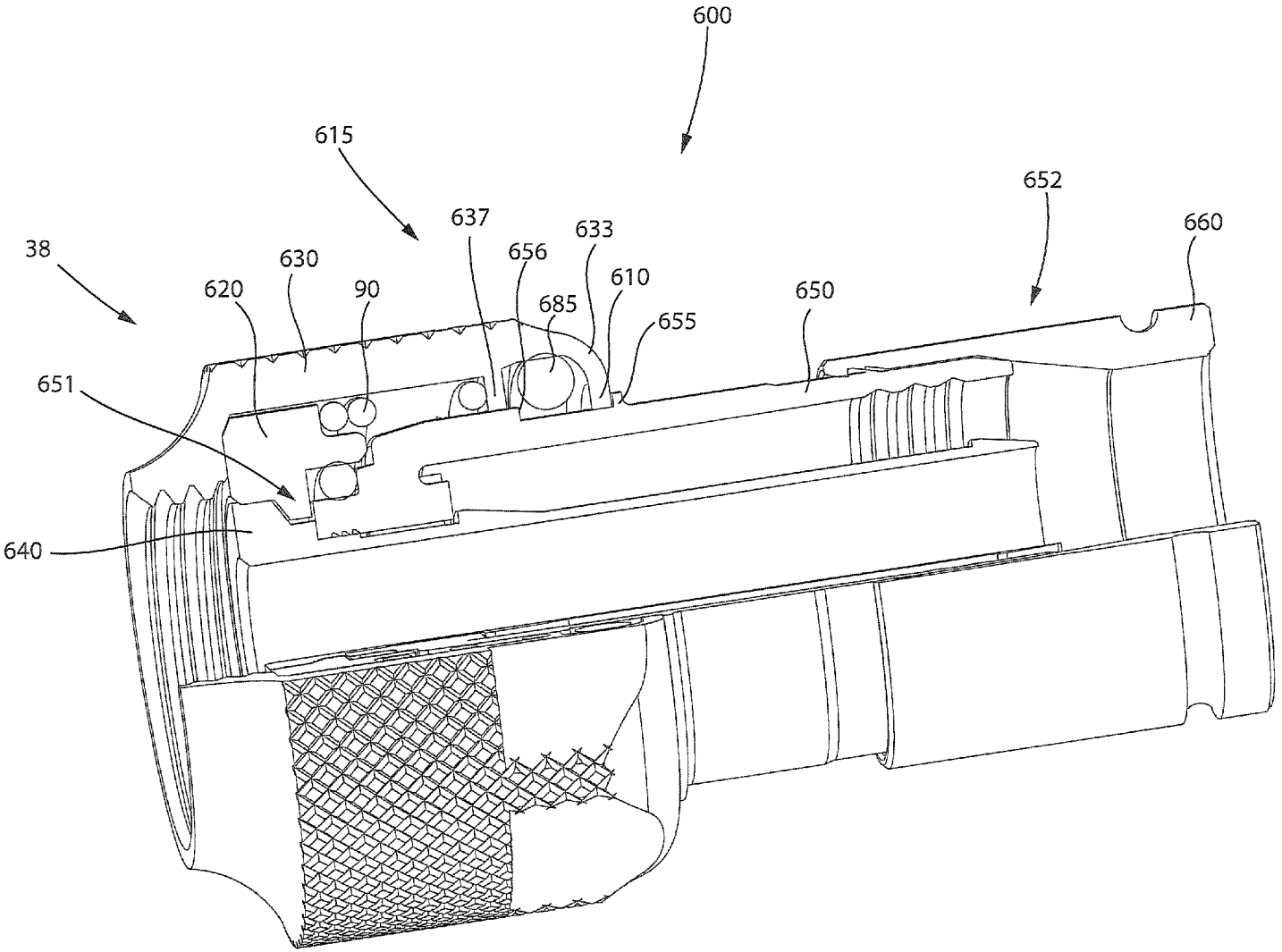
FIG. 13 depicts a perspective cut-away view of a still another embodiment of a coaxial cable connector in a first position, in accordance with the present invention.

FIG. 11 depicts a perspective cut-away view of still another embodiment of a connector 600 wherein a seal spacer 620 acts like a portion of a spring stop member (110,210) to influence axial movement of the nut 630 by physically interacting with a biasing member 90. A portion of the skirt 633 of the nut 630 slidably engages the connector body 650 and movably operates between a second end 652 external stop feature 655 and a first end 651 external stop feature 656 of the connector body 650. That movement obstructing portion of the skirt 633 of the nut, in cooperation with a seal spacer 620 works in combination as a spring stop member 610. The nut 630 includes an internal flange member 637 that interacts with the biasing member 90. The external stop feature 655 of the connector body 650 restricts axial movement of the nut 630 past a point, when the nut 630 is moved in a direction toward the second end 652 of the connector body 650. Likewise the external stop feature 656 of the connector body 650 restricts axial movement of the nut 630 past another point, when the nut 630 is moved in the opposite axial direction toward the first end 651 of the connector body 650. The seal spacer 620 and the internal flange member 637 of the nut 630 operate with the biasing member 90 to facilitate axial movement of the nut 630 with respect to other components of the coaxial cable connector 600 structure and tending the nut 630 to move in a direction toward the second end 652 of connector body 650. Because the biasing member 90 acts against the internal flange member 637 to drive the nut 630, there is no contact or resultant force between the biasing member 90 and the peened or bent over portion 633 of the nut 630. This is advantageous because less force is existent upon that bent over portion 633, thereby helping to protect the portion 633 from yielding due to contact with the biasing member 90. A joint stop sealing member 685, such as an O-ring, may be disposed between the bent over portion 633 of the nut 630 and the internal flange member 637 of the nut 630, so as to be movably compressed against the connector body 650 to seal off the connector 600 from ingress and/or egress of RF noise, as wells as preventing transmission of physical contaminants into the connector 600. As depicted in FIG. 13, the coaxial cable connector 600 structure is in a first position 38. The coaxial cable connector 600 includes a post 640.

Figure 14:
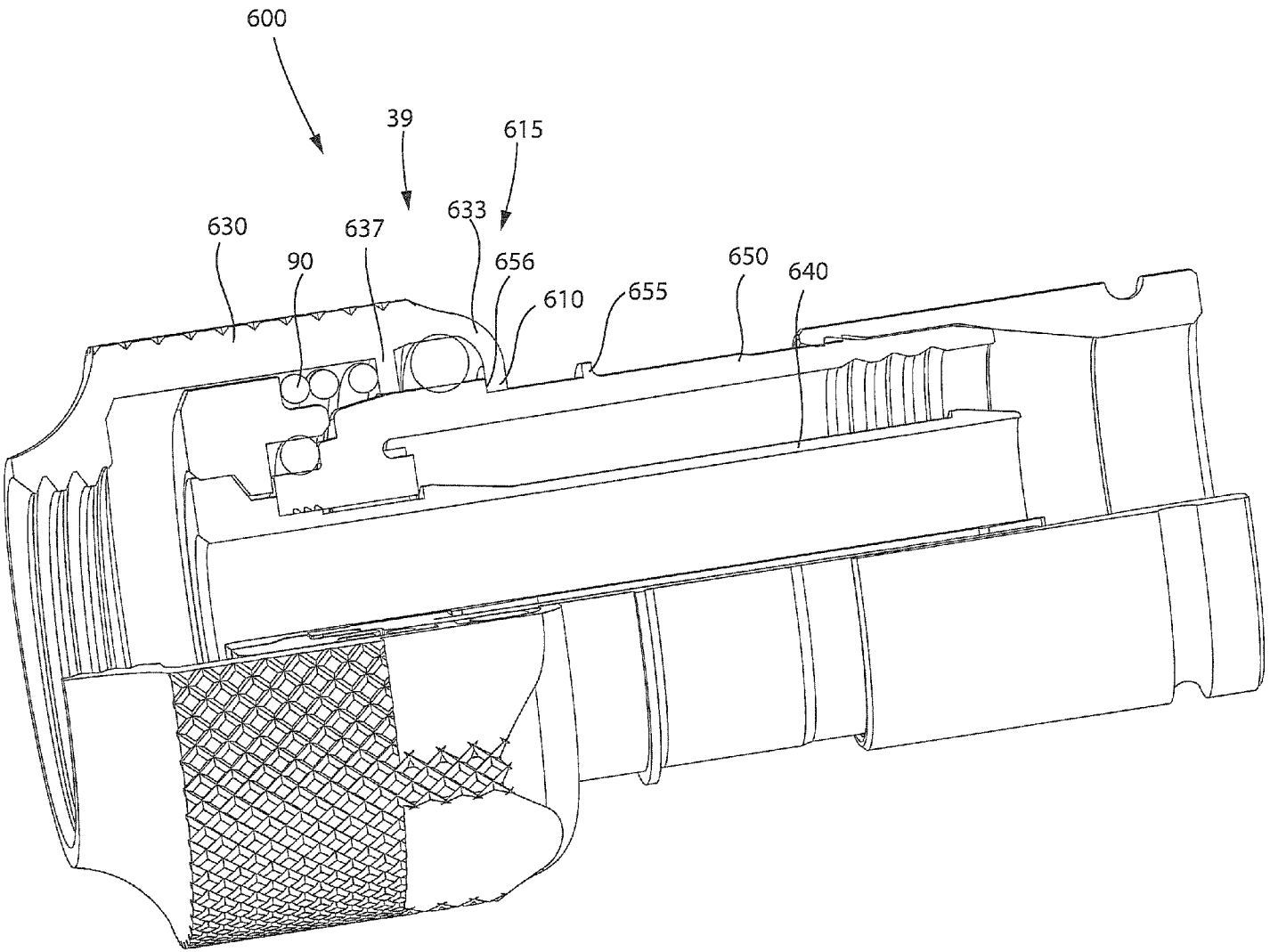
FIG. 14 depicts a perspective cut-away view of the embodiment of the coaxial cable connector of FIG. 13, wherein the connector is in a second position, in accordance with the present invention.

FIG. 14 depicts a perspective cut-away view of the embodiment of the connector 600 of FIG. 13, wherein the connector 600 is in a second position 39, in accordance with the present invention. Notably, the internal flange member 637 of the nut 630 is not part of a joint stop element 615. Rather, the external surface feature 656 protruding from the connector body 650, in operable combination with the spring stop member portion 610 of the skirt 633 of the nut 630, serve as movement impeding structures comprising a joint stop element 615, when the biasing member 90 is compressed and the connector 600 structure is in a second position 39, preventing further travel of the nut 630 toward the first end 651 of the body 650. This is advantageous in that no additional joint stop element component features are required to effectuate proper mating of the coaxial cable connector 600 to a corresponding coaxial cable interface port 20.

Figure 15:
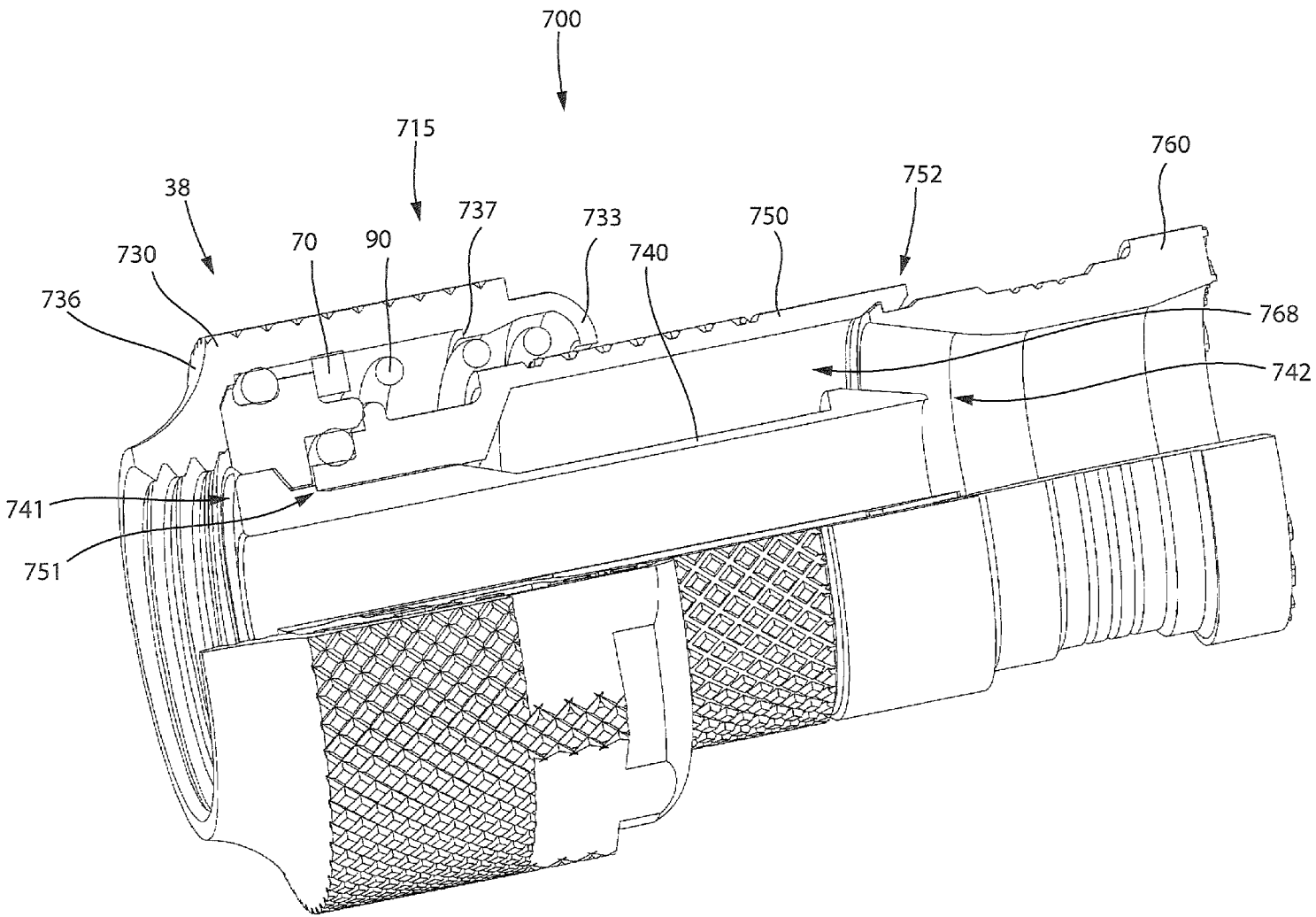
FIG. 15 depicts a perspective cut-away view of an embodiment of a radial compression type coaxial cable connector 600, in accordance with the present invention.

With further reference to the drawings, FIG. 15 depicts an embodiment of a radial compression type coaxial cable connector 700, in accordance with the present invention. The manner in which the coaxial cable connector 700 may be fastened to a received coaxial cable 10 is similar to the way a cable is fastened to a common CMP-type connector. The coaxial cable connector 700 includes an outer connector body 750 having a first end 751 and a second end 752. The body 750 at least partially surrounds a tubular inner post 740. The tubular inner post 740 has a first end 741 including a flange 744 and a second end 742 configured to mate with a coaxial cable 10 and contact a portion of the outer conductive grounding shield or sheath 14 of the cable 10. The connector body 750 is attached to a portion of the tubular post 740 proximate the first end 741 of the tubular post 740 and cooperates in a radially spaced relationship with the inner post 740 to define an annular chamber 768 with a rear opening. A tubular locking compression member 760 protrudes axially into the annular chamber 768 through its rear opening. The tubular locking compression member 760 is slidably coupled or otherwise movably affixed to the connector body 750 and is displaceable axially between a first open position (accommodating insertion of the tubular inner post 740 into a prepared cable 10 end to contact the grounding shield 14), and a second clamped position compressibly fixing the cable 10 within the chamber 768 of the connector 700. A coupler or nut 730 at the front end of the inner post 740 serves to attach the connector 700 to an interface port. The structural configuration and functional operation of the nut 730 and associated biasing member 90 and joint stop element 715 structure may be similar to the structure and functionality of similar components of a connector 100 described in FIGS. 1-5, and having reference numerals denoted similarly.

Referring to FIGS. 1-15, an embodiment of a method of extending an RF grounding shield from a coaxial cable 10 to a cable interface port 20 is described. The method is genotypical with respect to coaxial cable connector embodiments 100/200/300/400/500/600/700 described herein. The coaxial cable RF grounding shield extension method comprises a step of providing a coaxial cable connector 100/200/300/400/500/600/700 to connect the coaxial cable 10 to the interface port 20. The provided coaxial cable connector 100/200/300/400/500/600/700 comprises a connector body 50/250/350/450/550/650/750, having a first end 51/251/351/451/551/651/751 and a second end 52/252/352/452/552/652/752. Moreover, the coaxial cable connector 100/200/300/400/500/600/700 includes a post 40/240/340/440/540/640/740 attached to the connector body 50/250/350/450/550/650/750 and operable to receive the coaxial cable 10. In addition, the provided coaxial cable connector 100/200/300/400/500/600/700 includes a threaded nut 30/230/330/430/530/630/730, wherein the nut 30/230/330/430/530/630/730 is rotatable with respect to the post 40/240/340/440/540/640/740 and also axially movable with respect to the connector body 50/250/350/450/550/650/750 between a first position 38 and a second position 39. Furthermore, the provided coaxial cable connector 100/200/300/400/500/600/700 includes a biasing member 90/490, wherein the biasing member 90/490 is operable to exert force on the nut 30/230/330/430/530/630/730, which force tends the nut 30/230/330/430/530/630/730 to move in a direction toward the second end 52/252/352/452/552/652/753 of the connector body 50/250/350/450/550/650/750. Still further, the provided coaxial cable connector 100/200/300/400/500/600/700 includes a joint stop element 115/215/315/415/515/615/615. The joint stop element 115/215/315/415/515/615/715 is located to interact with the biasing member 90/490 and introduce obstructive structure that impedes axial movement of the nut 30/230/330/430/530/630/730. The nut 30/230/330/430/530/630/730 of the coaxial cable connector 100/200/300/400/500/600/700 is movable in an axial direction toward the first end 51/251/351/451/551/651/751 of the connector body 50/250/350/450/550/650/750 when in a first position 38. However, the nut 30/230/330/430/530/630/730 is not movable in a direction toward the first end 51/251/351/451/551/651/751 of the connector body 50/250/350/450/550/650/750 when in a second position 39, because the obstructive structure of the joint stop element 115/215/315/415/515/615/715 physically impedes further movement of the nut 30/230/330/430/530/630/730.

Embodiments of the provided coaxial cable connector 100/200/300/400/500/600 may include a fastener member 60/260/360/460/560/660. The fastener member 60/260/360/460/560/660 may include an internal ramped surface, such as surface 66. The fastener member 60/260/360/460/560/660 is operable to deformably compress an outer surface, such as surface 54, of the connector body 50/250/350/450/550/650 to axially secure the received coaxial cable 10 between the connector body 50/250/350/450/550/650 and the fastener member 60/260/360/460/560/660. Other embodiments of the provided coaxial cable connector 700 may include a tubular locking compression member 760 located to protrude axially into an annular chamber 768 of the connector 700 through its rear opening. The tubular locking compression member 760 is slidably coupled or otherwise movably affixed to the connector body 750 and is displaceable axially between a first open position, accommodating insertion of the tubular inner post 740 into a prepared cable 10 end to electrically contact the grounding shield 14, and a second clamped position compressibly fixing the cable 10 within the chamber 768 of the connector 700.

An additional methodological step in extending an RF grounding shield from a coaxial cable 10 to a cable interface port 20 includes rotating the nut 30/230/330/430/530/630 to thread the nut 30/230/330/430/530/630 onto the interface port 20 a distance sufficient for the post 40/240/340/440/540/640 of the connector 100/200/300/400/500/600 to contact the port 40/240/340/440/540/640. The position of the connector structure when the post 40/240/340/440/540/640 initially contacts the port 20 corresponds to a first position 38.

Further methodology for extending the RF shield from a coaxial cable 10 to a port 20 includes advancing and tightening the nut 30/230/330/430/530/630 further onto the port 20 to ensure electrical contact between a mating edge 26 of the port 20 and a mating edge, such as mating edge 46, of the post 40/240/340/440/540/640. As the nut 30/230/330/430/530/630 advances onto the port 20 it axially slidably moves with respect to the post 40/240/340/440/540/640 and connector body 50/250/350/450/550/650 in a direction toward the first end 51/251/351/451/551/651 of the connector body 50/250/350/450/550/650, so that the associated biasing member 90/490 exerts resultant force to drive the post 40/240/340/440/540/640 into firm contact with the interface port 20.

Still another methodological step in extending an RF grounding shield from a coaxial cable 10 to a cable interface port 20 includes impeding further axial movement of the nut 30/230/330/430/530/630 with respect to the post 40/240/340/440/540/640 and the connector body 50/250/350/450/550/650, by bottoming out the movement of the nut 30/230/330/430/530/530 through operation of obstructive structure of the joint stop element 115/215/315/415/515/615 so that the bottoming out of the movement of the nut 30/230/330/430/530/630 corresponds to a second position 39. In a second position 39, the nut 30/230/330/430/530/630 is no longer axially movable in a direction toward the first end 51/251/351/451/55/651 of the connector body 50/250/350/450/550/650.

The bottoming out of the nut 30/230/330/430/530/630, in the method of extending an RF grounding shield from a coaxial cable 10 to a cable interface port 20, helps prevent over-compressing of the biasing member 90/490 and may correspond to a physical condition associated with tightening torque in compliance with industry standard torque installation guidelines and optimal performance of the coaxial cable connector 100/200/300/400/500/600. The nut 30/230/330/430/530/630 may include hex flats, such as hex flats 35, and may be tightened onto the interface port 20 through use of a wrench. Moreover, the nut 30/230/330/430/530/630 may include a port seal surface feature, such as surface feature 36, and the installation of the nut 30/230/330/430/530/630 on the port 20 may further include securing a port seal 136 over and around portions of the port 20 and the nut 30/230/330/430/530/630, including the port seal surface feature, such as surface feature 36, to prevent ingress of environmental contaminants.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

What is claimed is:

1. An F-type coaxial cable connector comprising:

a connector body, having a first end and a second end;

a post, attached to the connector body;

a threaded nut, rotatable with respect to the post and also axially movable with respect to the connector body between a first position and a second position;

a biasing member, internally located axially and radially within the nut, the biasing member compressably operable to exert force on the nut tending the nut to move in a direction toward the second end of the connector body; and a joint stop element, located to operably interact with the biasing member and introduce obstructive structure that impedes axial movement of the nut;

wherein the nut is movable in an axial direction toward the first end of the connector body when in the first position; and wherein when the nut is located in the second position, the nut is no longer movable in a direction toward the first end of the connector body, because the obstructive structure of the joint stop element physically impedes further movement of the nut.

2. The connector of claim 1, wherein the joint stop element comprises a spring stop member being operably sized and located to abut an internal stop feature of the nut, when the biasing member has been compressed and the nut has been moved to the second position.

3. The connector of claim 2, wherein the spring stop member is a split ring washer.

4. The connector of claim 1, wherein the joint stop element comprises a double spring stop member being operably sized and located to abut an internal stop feature of the nut, when the biasing member has been compressed and the nut has been moved to the second position.

5. The connector of claim 4, wherein the double spring stop member comprises two ring washers axially positioned next to one another.

6. The connector of claim 1, wherein the joint stop element comprises an enlarged flange of the post being operably sized and located to abut an internal stop feature of the nut, when the biasing member has been compressed and the nut has been moved to the second position.

7. The connector of claim 1, further comprising a fastener member including an internal ramped surface and an external detent, the fastener member operable to deformably compress the outer surface of the connector body to compressably secure a coaxial cable.

8. The connector of claim 7, wherein the joint stop element comprises a spring stop member portion of a skirt of the nut being operably sized and located to abut opposing edges of the external detent of the fastener member, when the biasing member has been compressed and the nut has been moved to the second position.

9. The connector of claim 8, wherein the connector body resides completely within the internal boundaries of the nut, when the nut is in the first position.

10. The connector of claim 1, wherein the joint stop element comprises a spring stop member portion of a skirt of the nut being operably sized and located to move between and abut one of two spaced-apart external stop features protruding from the connector body, when the biasing member has been compressed and the nut has been moved to the second position.

11. The connector of claim 1, further comprising a seal spacer, the seal spacer including a lip operatively configured to contact a corresponding flange of the post thereby facilitating the prevention of axial movement of the post in the direction of the seal spacer.

12. The connector of claim 11, further comprising a nut sealing member configured and located to reside in an annular pocket of the seal spacer, so that the nut sealing member is compressed between an inner surface of the nut and the seal spacer, to foster a physical seal between the nut and the sealing member.

13. The connector of claim 11, further comprising a body sealing member residing in an annular recess positioned at the first end of the connector body, so that the body sealing member is compressed between the connector body and a portion of the seal spacer.

14. The connector of claim 1, wherein the nut includes hex flats.

15. The connector of claim 1, wherein the nut includes a port seal surface feature located on the external portion of the nut proximate the first end of the nut and configured to facilitate mating of a port seal to help seal the connector against ingress of unwanted environmental contaminants.

16. An F-type coaxial cable connector for coupling a coaxial cable to an interface port, the coaxial cable including a center conductor surrounded by a dielectric material, the dielectric material being surrounded by an outer conductive grounding shield, the outer conductive grounding shield surrounded by a protective outer jacket, the F-type coaxial cable connector comprising in combination:

a connector body, having a first end and a second end, the second end configured to deformably compress against and seal a received coaxial cable;

a post, axially securely attached to the connector body, the post having a first end and a second end, the first end of the post including a flange and the second end of the post configured to be inserted into an end of the received coaxial cable around the dielectric and under at least one layer of the conductive grounding shield thereof;

a threaded nut, rotatable with respect to the post and also axially movable with respect to the connector body between a first position and a second position;

a biasing member, the biasing member compressably operable to exert force on the nut tending the nut to move in a direction toward the second end of the connector body;

a fastener member, including an internal ramped surface, the fastener member operable to deformably compress the outer surface of the connector body to axially secure the received coaxial cable between the connector body and the fastener member; and a joint stop element, including a first obstructive structure of the connector that is axially movable with respect to the received and secured cable and including a second obstructive structure that is not movable with respect to the received and secured cable;

wherein the movable first obstructive structure contacts the non-axially movable second obstructive structure when the nut is in the second position to impede axial movement of the nut in a direction toward the first end of the connector body.

17. The connector of claim 16, wherein an internal stop feature of the nut comprises the first obstructive structure that is axially movable with respect to the cable and a spring stop member comprises the second obstructive structure that is not axially movable with respect to the cable.

18. The connector of claim 16, wherein an internal stop feature of the nut comprises the first obstructive structure that is axially movable with respect to the cable and a double spring stop member comprises the second obstructive structure that is not axially movable with respect to the cable.

19. The connector of claim 16, wherein an internal stop feature of the nut comprises the first obstructive structure that is axially movable with respect to the cable and an enlarged flange of the post comprises the second obstructive structure that is not axially movable with respect to the cable.

20. The connector of claim 16, wherein a stop member portion of a skirt of the nut comprises the first obstructive structure that is axially movable with respect to the cable and an external detent of the fastener member comprises the second obstructive structure that is not axially movable with respect to the cable.

21. The connector of claim 16, wherein a stop member portion of a skirt of the nut comprises the first obstructive structure that is axially movable with respect to the cable and an external surface feature protruding from the connector body comprises the second obstructive structure that is not axially movable with respect to the cable.

22. A coaxial cable connector comprising:

a connector body;

a post, attached to the connector body;

a threaded nut, rotatable with respect to the post and also axially movable with respect to the connector body between a first position and a second position;

a biasing member, operable to exert force on the nut to move the nut; and means for impeding axial movement of the nut in one axial direction, when the nut resides in the second position;

wherein the means remain structurally sound during the buildup of axial force applied thereto, as threadable rotational torque is exerted when the nut is tightened into mating with a corresponding interface port, through operation of a wrench; and wherein the means prevent the connector from experiencing structural and functional deformation because the movement impediments of the means prevent the biasing member from being over-compressed causing connector components to yield and thus not properly function during repetitive use.

23. A method of extending an RF grounding shield from a coaxial cable to a cable interface port, the method comprising:

providing an F-type coaxial cable connector to connect the coaxial cable to the interface port, the F-type coaxial cable connector comprising:

a connector body, having a first end and a second end;

a post, attached to the connector body and operable to receive the coaxial cable;

a threaded nut, rotatable with respect to the post and also axially movable with respect to the connector body between a first position and a second position;

a biasing member, operable to exert force on the nut tending the nut to move in a direction toward the second end of the connector body; and a joint stop element, located to interact with the biasing member and introduce obstructive structure that impedes axial movement of the nut;

wherein the nut is movable in an axial direction toward the first end of the connector body when in the first position; and wherein when the nut is located in the second position, the nut is no longer movable in a direction toward the first end of the connector body, because the obstructive structure of the joint stop element physically impedes further movement of the nut;

rotating the nut to thread the nut onto the interface port a distance sufficient for the post of the connector to contact the port, wherein the position of the connector structure when the post initially contacts the port corresponds to the first position;

advancing and tightening the nut further onto the port to ensure electrical contact between a mating edge of the port and a mating edge of the post, wherein, as the nut advances onto the port it axially slidably moves with respect to the post and connector body in a direction toward the first end of the connector body, so that the associated biasing member exerts resultant force to drive the post into firm contact with the interface port; and impeding further axial movement of the nut with respect to the post and the connector body, by bottoming out the movement of the nut through operation of obstructive structure of the joint stop element so that the bottoming out of the movement of the nut corresponds to the second position, wherein the nut is no longer axially movable in a direction toward the first end of the connector body.

24. The method of claim 23, wherein the nut includes hex flats and is tightened onto the interface port through use of a wrench.

25. The method of claim 23, wherein the connector further includes a fastener member, including an internal ramped surface, the fastener member operable to deformably compress the outer surface of the connector body to axially secure the received coaxial cable between the connector body and the fastener member.

26. The method of claim 23, wherein the connector further includes a tubular locking compression member located to protrude axially into an annular chamber of the connector through its rear opening, the tubular locking compression member being slidably coupled to the connector body displaceable axially between a first open position, accommodating insertion of the post into a prepared cable end to electrically contact the grounding shield, and a second clamped position compressibly fixing the cable within the chamber of the connector.

27. The method of claim 23, wherein the nut includes a port seal surface feature and the installation of the nut on the port further includes securing a port seal over and around portions of the port and the nut, including the port seal surface feature, to prevent ingress of environmental contaminants.

28. The method of claim 23, wherein the bottoming out of the nut prevents over-compressing of the biasing member and corresponds to a physical condition associated with tightening torque in compliance with industry standard torque installation guidelines and optimal performance of the coaxial cable connector.

29. A coaxial cable connector comprising:

a connector body, having a first end and a second end;

a post, attached to the connector body;

a threaded nut, rotatable with respect to the post and also axially movable with respect to the connector body between a first position and a second position;

a biasing member, internally located axially and radially within the nut, the biasing member compressably operable to exert force on the nut tending the nut to move in a direction toward the second end of the connector body; and a joint stop element, located to operably interact with the biasing member and introduce obstructive structure that impedes axial movement of the nut;

wherein the nut is movable in an axial direction toward the first end of the connector body when in the first position; and wherein when the nut is located in the second position, the nut is no longer movable in a direction toward the first end of the connector body, because the obstructive structure of the joint stop element physically impedes further movement of the nut.

30. The connector of claim 29, wherein the joint stop element comprises a spring stop member being operably sized and located to abut an internal stop feature of the nut, when the biasing member has been compressed and the nut has been moved to the second position.

31. The connector of claim 30, wherein the spring stop member is a split ring washer.

32. The connector of claim 29, wherein the joint stop element comprises a double spring stop member being operably sized and located to abut an internal stop feature of the nut, when the biasing member has been compressed and the nut has been moved to the second position.

33. The connector of claim 32, wherein the double spring stop member comprises two ring washers axially positioned next to one another.

34. The connector of claim 29, wherein the joint stop element comprises an enlarged flange of the post being operably sized and located to abut an internal stop feature of the nut, when the biasing member has been compressed and the nut has been moved to the second position.

35. The connector of claim 29, further comprising a fastener member including an internal ramped surface and an external detent, the fastener member operable to deformably compress the outer surface of the connector body to compressably secure a coaxial cable.

36. The connector of claim 35, wherein the joint stop element comprises a spring stop member portion of a skirt of the nut being operably sized and located to abut opposing edges of the external detent of the fastener member, when the biasing member has been compressed and the nut has been moved to the second position.

37. The connector of claim 36, wherein the connector body resides completely within the internal boundaries of the nut, when the nut is in the first position.

38. The connector of claim 29, wherein the joint stop element comprises a spring stop member portion of a skirt of the nut being operably sized and located to move between and abut one of two spaced-apart external stop features protruding from the connector body, when the biasing member has been compressed and the nut has been moved to the second position.

39. The connector of claim 29, further comprising a seal spacer, the seal spacer including a lip operatively configured to contact a corresponding flange of a post thereby facilitating the prevention of axial movement of the post in the direction of the seal spacer.

40. The connector of claim 39, further comprising a nut sealing member configured and located to reside in an annular pocket of the seal spacer, so that the nut sealing member is compressed between an inner surface of the nut and the seal spacer, to foster a physical seal between the nut and the sealing member.

41. The connector of claim 39, further comprising a body sealing member residing in an annular recess positioned at the first end of the connector body, so that the body sealing member is compressed between the connector body and a portion of the seal spacer.

42. The connector of claim 29, wherein the nut includes hex flats.

43. The connector of claim 29, wherein the nut includes a port seal surface feature located on the external portion of the nut proximate the first end of the nut and configured to facilitate mating of a port seal to help seal the connector against ingress of unwanted environmental contaminants.

44. A coaxial cable connector for coupling a coaxial cable to an interface port, the coaxial cable including a center conductor surrounded by a dielectric material, the dielectric material being surrounded by an outer conductive grounding shield, the outer conductive grounding shield surrounded by a protective outer jacket, the coaxial cable connector comprising in combination:

a connector body, having a first end and a second end, the second end configured to deformably compress against and seal a received coaxial cable;

a post, axially securely attached to the connector body, the post having a first end and a second end, the first end of the post including a flange and the second end of the post configured to be inserted into an end of the received coaxial cable around the dielectric and under at least one layer of the conductive grounding shield thereof;

a threaded nut, rotatable with respect to the post and also axially movable with respect to the connector body between a first position and a second position;

a biasing member, the biasing member compressably operable to exert force on the nut tending the nut to move in a direction toward the second end of the connector body;

a fastener member, including an internal ramped surface, the fastener member operable to deformably compress the outer surface of the connector body to axially secure the received coaxial cable between the connector body and the fastener member; and a joint stop element, including a first obstructive structure of a component of the connector that is axially movable with respect to the received and secured cable and including a second obstructive structure of a component that is not movable with respect to the received and secured cable;

wherein the moveable first obstructive structure contacts the non-axially movable second obstructive structure when the nut is in the second position to impede axial movement of the nut in a direction toward the first end of the connector body.

45. The connector of claim 44, wherein an internal stop feature of the nut comprises the first obstructive structure that is axially movable with respect to the cable and a spring stop member comprises the second obstructive structure that is not axially movable with respect to the cable.

46. The connector of claim 44, wherein an internal stop feature of the nut comprises the first obstructive structure that is axially movable with respect to the cable and a double spring stop member comprises the second obstructive structure that is not axially movable with respect to the cable.

47. The connector of claim 44, wherein an internal stop feature of the nut comprises the first obstructive structure that is axially movable with respect to the cable and an enlarged flange of the post comprises the second obstructive structure that is not axially movable with respect to the cable.

48. The connector of claim 44, wherein a stop member portion of a skirt of the nut comprises the first obstructive structure that is axially movable with respect to the cable and an external detent of the fastener member comprises the second obstructive structure that is not axially movable with respect to the cable.

49. The connector of claim 44, wherein a stop member portion of a skirt of the nut comprises the first obstructive structure that is axially movable with respect to the cable and an external surface feature protruding from the connector body comprises the second obstructive structure that is not axially movable with respect to the cable.

50. A method of extending an RF grounding shield from a coaxial cable to a cable interface port, the method comprising:

providing a coaxial cable connector to connect the coaxial cable to the interface port, the coaxial cable connector comprising:

a connector body, having a first end and a second end;

a post, attached to the connector body and operable to receive the coaxial cable;

a threaded nut, rotatable with respect to the post and also axially movable with respect to the connector body between a first position and a second position;

a biasing member, operable to exert force on the nut tending the nut to move in a direction toward the second end of the connector body; and a joint stop element, located to interact with the biasing member and introduce obstructive structure that impedes axial movement of the nut;

wherein the nut is movable in an axial direction toward the first end of the connector body when in the first position; and wherein when the nut is located in the second position it is no longer movable in a direction toward the first end of the connector body, because the obstructive structure of the joint stop element physically impedes further movement of the nut;

rotating the nut to thread the nut onto the interface port a distance sufficient for the post of the connector to contact the port, wherein the position of the connector structure when the post initially contacts the port corresponds to the first position;

advancing and tightening the nut further onto the port to ensure electrical contact between a mating edge of the port and a mating edge of the post, wherein, as the nut advances onto the port it axially slidably moves with respect to the post and connector body in a direction toward the first end of the connector body, so that the associated biasing member exerts resultant force to drive the post into firm contact with the interface port; and impeding further axial movement of the nut with respect to the post and the connector body, by bottoming out the movement of the nut through operation of obstructive structure of the joint stop element so that the bottoming out of the movement of the nut corresponds to the second position, wherein the nut is no longer axially movable in a direction toward the first end of the connector body.

51. The method of claim 50, wherein the nut includes hex flats and is tightened onto the interface port through use of a wrench.

52. The method of claim 50, wherein the connector further includes a fastener member, including an internal ramped surface, the fastener member operable to deformably compress the outer surface of the connector body to axially secure the received coaxial cable between the connector body and the fastener member.

53. The method of claim 50, wherein the connector further includes a tubular locking compression member located to protrude axially into an annular chamber of the connector through its rear opening, the tubular locking compression member being slidably coupled to the connector body displaceable axially between a first open position, accommodating insertion of the post into a prepared cable end to electrically contact the grounding shield, and a second clamped position compressibly fixing the cable within the chamber of the connector.

54. The method of claim 50, wherein the nut includes a port seal surface feature and the installation of the nut on the port further includes securing a port seal over and around portions of the port and the nut, including the port seal surface feature, to preventingress of environmental contaminants.

55. The method of claim 50, wherein the bottoming out of the nut prevents over-compressing of the biasing member and corresponds to a physical condition associated with tightening torque in compliance with industry standard torque installation guidelines and optimal performance of the coaxial cable connector.

* * * * *